US008607573B2

(12) United States Patent
Miura et al.

(10) Patent No.: US 8,607,573 B2
(45) **Date of Patent: *Dec. 17, 2013**

(54) COMBUSTOR HAVING A FIRST PLURALITY OF FUEL NOZZLES HAVING A FIRST CROSS-SECTIONAL SHAPE AND A SECOND PLURALITY OF FUEL NOZZLES HAVING A SECOND CROSS-SECTIONAL SHAPE DIFFERENT THAN THE FIRST CROSS-SECTIONAL SHAPE

(75) Inventors: Keisuke Miura, Hitachi (JP); Hiroshi Inoue, Mito (JP); Kazuhito Koyama, Hitachi (JP); Takeo Saito, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 42 days.

This patent is subject to a terminal disclaimer.

(21) Appl. No.: 13/339,262

(22) Filed: Dec. 28, 2011

(65) Prior Publication Data

US 2012/0094239 A1 Apr. 19, 2012

Related U.S. Application Data

(63) Continuation of application No. 12/108,162, filed on Apr. 23, 2008, now Pat. No. 8,104,284.

(30) Foreign Application Priority Data

Apr. 26, 2007 (JP) ..... 2007-116305
Mar. 31, 2008 (JP) ..... 2008-089154

(51) Int. Cl.
*F02C 1/00* (2006.01)
*F02G 3/00* (2006.01)

(52) U.S. Cl.
USPC ..... 60/747; 60/737; 60/746; 60/739

(58) Field of Classification Search
USPC ..... 60/737, 746, 747, 733, 739; 431/174, 431/179, 284, 285
See application file for complete search history.

(56) References Cited

U.S. PATENT DOCUMENTS

| | | | |
|---|---|---|---|
| 6,813,889 | B2 | 11/2004 | Inoue et al. |
| 6,912,854 | B2 | 7/2005 | Inoue et al. |
| 6,928,823 | B2 | 8/2005 | Inoue et al. |
| 6,986,255 | B2 | 1/2006 | Smith et al. |
| 7,117,677 | B2 | 10/2006 | Inoue et al. |

(Continued)

FOREIGN PATENT DOCUMENTS

| | | |
|---|---|---|
| JP | 64-038522 | 2/1989 |
| JP | 2003-148734 | 5/2003 |

(Continued)

*Primary Examiner* — William H Rodriguez
(74) *Attorney, Agent, or Firm* — Mattingly & Malur, PC

(57) ABSTRACT

A combustor includes a chamber mixing and burning fuel and air and an air hole plate disposed on a wall surface of the chamber. The air hole plate includes a plurality of rows disposed concentrically of a plurality of air holes jetting coaxial jets of fuel and air into the chamber. A first fuel nozzle and a second fuel nozzle are disposed near a fuel hole for jetting fuel into an air hole row on an inner peripheral side. The first fuel nozzle is structured to suppress turbulence of surrounding air flow and the second fuel nozzle is structured to promote turbulence of a surrounding air flow. In accordance with the aspect of the present invention, good flame stability can be maintained while further reducing NOx in a combustor using coaxial jets.

9 Claims, 27 Drawing Sheets

(56) References Cited

U.S. PATENT DOCUMENTS

| | | | | |
|---|---|---|---|---|
| 7,188,476 | B2 | 3/2007 | Inoue et al. | |
| 7,200,998 | B2 | 4/2007 | Inoue et al. | |
| 7,313,919 | B2 | 1/2008 | Inoue et al. | |
| 7,343,745 | B2 | 3/2008 | Inoue et al. | |
| 7,426,833 | B2 | 9/2008 | Yoshida et al. | |
| 7,469,544 | B2 | 12/2008 | Farhangi | |
| 7,571,609 | B2 | 8/2009 | Yoshida et al. | |
| 7,571,612 | B2 | 8/2009 | Yoshida et al. | |
| 7,581,379 | B2 | 9/2009 | Yoshida et al. | |
| 7,673,455 | B2 | 3/2010 | Yoshida et al. | |
| 8,104,284 | B2 * | 1/2012 | Miura et al. | 60/746 |
| 2003/0046935 | A1 | 3/2003 | Halila et al. | |
| 2008/0229755 | A1 | 9/2008 | Koganezawa et al. | |
| 2008/0268387 | A1 | 10/2008 | Saito et al. | |
| 2009/0173075 | A1 | 7/2009 | Miura et al. | |
| 2009/0293484 | A1 | 12/2009 | Inoue et al. | |

FOREIGN PATENT DOCUMENTS

| | | |
|---|---|---|
| JP | 2004-170010 | 6/2004 |
| JP | 2005-030667 | 2/2005 |
| JP | 2006-017381 | 1/2006 |
| JP | 2006-189252 | 7/2006 |
| JP | 2007-232234 | 9/2007 |

* cited by examiner

COMBUSTOR HAVING A FIRST PLURALITY OF FUEL NOZZLES HAVING A FIRST CROSS-SECTIONAL SHAPE AND A SECOND PLURALITY OF FUEL NOZZLES HAVING A SECOND CROSS-SECTIONAL SHAPE DIFFERENT THAN THE FIRST CROSS-SECTIONAL SHAPE

This application is a continuation of U.S. patent application Ser. No. 12/108,162, filed Apr. 23, 2008, now U.S. Pat. No. 8,104,284.

BACKGROUND OF THE INVENTION

1. Field of the Invention

The present invention relates to a combustor and a fuel supply method for the combustor.

2. Description of the Related Art

JP-A-2003-148734 discloses a combustor that includes a large plurality of air holes jetting coaxial jets having air jets and fuel jets disposed coaxially or substantially coaxially. The combustor uniformly diffuses fuel and air and supplies them to a chamber. The combustor mixes the fuel and air in a short distance to prevent backfire and promote low NOx combustion. Part of the plurality of air holes includes a swirl angle to form a swirl flow in the chamber, so that a recirculation zone or a low flow rate zone is formed at a central portion of the swirl flow to hold a flame.

SUMMARY OF THE INVENTION

The combustor disclosed in JP-A-2003-148734 poses a problem in that increasing a mixing intensity of fuel and air further for NOx reduction results in a lower burning velocity in a flame holding region, impairing flame stability.

It is an object of the present invention to maintain flame stability in a combustor using coaxial jets even if NOx is further reduced.

To achieve the foregoing object, there is provided a combustor having arrangements as detailed below according to an aspect of the present invention. Specifically, the combustor comprises a chamber, an air hole plate, a first fuel nozzle, and a second fuel nozzle. The chamber mixes and burns fuel and air. The air hole plate is disposed on a wall surface of the chamber. The air hole plate includes a plurality of rows disposed concentrically of a plurality of air holes jetting coaxial jets of fuel and air into the chamber. The first fuel nozzle and the second fuel nozzle are disposed near a fuel hole jetting fuel into an air hole row on an inner peripheral side. The first fuel nozzle is structured to suppress turbulence of a surrounding air flow, while the second fuel nozzle is structured to promote turbulence of a surrounding air flow.

In accordance with the aspect of the present invention, good flame stability can be maintained even by further reducing NOx in a combustor using coaxial jets.

BRIEF DESCRIPTION OF THE DRAWINGS

The present invention will be described hereinafter with reference to the accompanying drawings.

DETAILED DESCRIPTION OF THE PREFERRED EMBODIMENTS

Figure 6:
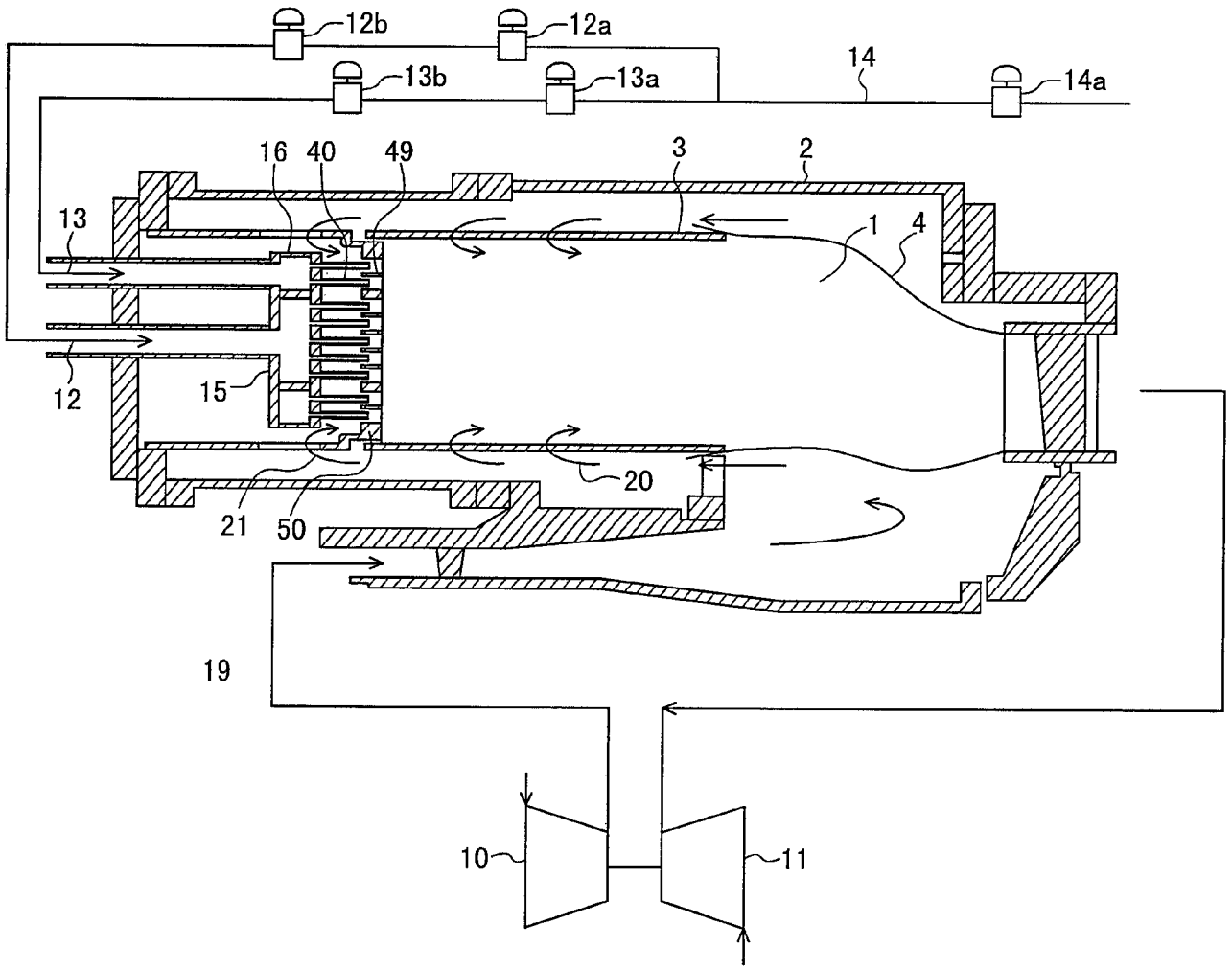
FIG. 6 is a longitudinal cross-sectional view showing schematically and generally the gas turbine combustor according to the first embodiment of the present invention.

FIG. 6 is a view showing schematically and generally a gas turbine combustor according to a preferred embodiment of the present invention.

An air 19 compressed by a compressor 10 flows between an outer casing 2 and a combustor liner 3. Part of the air 19 flows into a chamber 1 as a cooling air 20 for cooling the combustor liner 3. The rest of the air 19 flows through an air hole 49 into the chamber 1 as a combustion air 21.

In accordance with the preferred embodiment of the present invention, a fuel supply system 12 and a fuel supply system 13 are divided from a fuel supply system 14 including a control valve 14*a*. The fuel supply system 12 includes a control valve 12*a* and the fuel supply system 13 includes a control valve 13*a*, each being controlled independently of each other. The fuel supply system 12 and the fuel supply system 13 further include shutoff valves 12*b*, 13*b*, respectively, disposed downwardly of the control valves 12*a*, 13*a*.

Referring to FIG. 6, a combustor according to the preferred embodiment of the present invention includes a plurality of fuel nozzles 40. The fuel nozzles 40 are connected to fuel headers 15, 16 that distribute fuel to the plurality of fuel nozzles 40. The fuel supply system 12 supplies the fuel header 15 with fuel, while the fuel supply system 13 supplies the fuel header 16 with fuel. Having a control valve incorporated therein, each of the fuel supply systems can control a group of parts of the plurality of fuel nozzles 40.

Each of the plurality of fuel nozzles 40 is paired up with a corresponding one of the air holes 49. The fuel supplied to the fuel headers 15, 16 is jetted from the fuel nozzle 40 to the air hole 49. The fuel and air jetted from the air hole 49 flow into, and are mixed together in, the chamber 1 to form a homogeneous, stable flame. Generated high-temperature combustion gas is supplied to a turbine 11, performs its work, and then is exhausted.

First Embodiment

Figure 1:
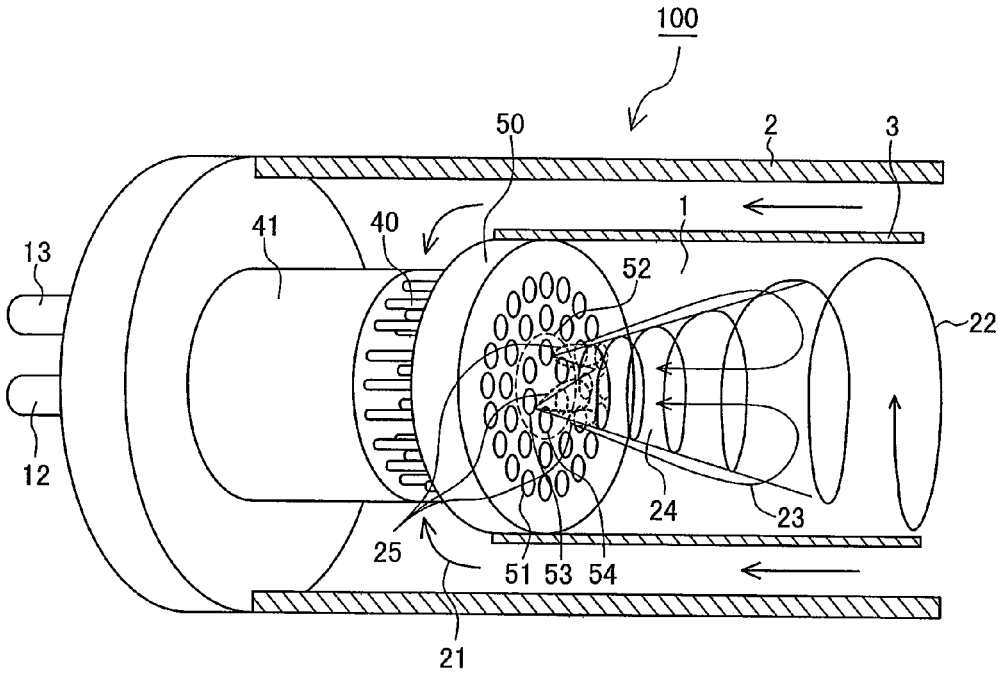
FIG. 1 is a view showing a gas turbine combustor according to a first embodiment of the present invention.

FIG. 1 is a perspective view showing a combustor 100. The combustor 100 includes a large plurality of fuel nozzles 40 and a large plurality of air holes (51, 53, and 54). Each of the fuel nozzles 40 and the air holes (51, 53, and 54) is paired up with each other. The combustion air 21 flows between the combustor liner 3 and the outer casing 2 and around the fuel nozzles 40 before being jetted into the chamber 1 through the air holes. The air holes (53, 54) inside a central broken line 52 of an air hole plate 50 have a swirl angle that causes a jet to swirl in a circumferential direction of the combustor 100. A jet jetted from the air holes (53, 54) forms a swirl flow 22 downstream of a burner. A flame 24 is held by a recirculation flow 23 formed at an axial center of the combustor 100. The swirl flow 22 refers to a large spiral stream of a plurality of coaxial jets formed continuously and annularly by coaxial jets jetted from the air holes (53, 54) circumferentially relative to the axis of the combustor 100.

Fuel is supplied via the fuel header 15 from the fuel supply system 12 to fuel nozzles corresponding to the air holes (53, 54) inside the central broken line 52 of the air hole plate 50. Fuel is supplied via the fuel header 16 from the fuel supply system 13 to the air hole (51) outside the central broken line 52 of the air hole plate 50. In addition, the fuel headers 15, 16 are of a dual pipe structure, allowing fuel from the fuel supply system 12 to be supplied separately from fuel from the fuel supply system 13.

Figure 2:
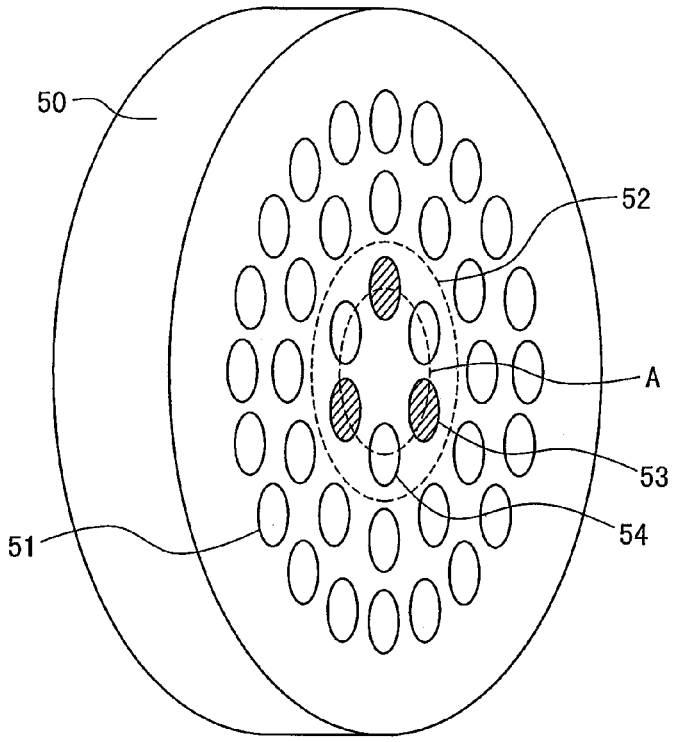
FIG. 2 is an end view showing a burner according to the first embodiment of the present invention.

FIG. 2 is an enlarged view showing the air hole plate 50. A plurality of air holes is disposed circumferentially relative to the axis of the combustor 100, forming a row. In FIG. 1, the axis of the combustor 100 coincides with a cylindrical axis of the cylindrical combustor liner 3. The air holes are disposed radially concentrically. In FIG. 2, there are three rows of air holes. A total of six air holes 53, 54 are disposed inside the central broken line 52 of the air hole plate 50. The air holes 53, 54 disposed in an inner region inside the central broken line 52 have an inclined angle relative to the air hole plate 50. Coaxial jets jetted from the air holes 53, 54 are jetted circumferentially relative to the axis of the combustor 100, which allows a flame to be held in the inner region inside the central broken line 52. The air hole 51 disposed in an outer region outside the central broken line 52 is formed perpendicularly to a chamber wall surface of the air hole plate 50.

In accordance with the first embodiment of the present invention, fuel nozzles paired up with the air holes disposed inside the central broken line 52 comprise a first fuel nozzle group and a second fuel nozzle group. Fuel nozzles paired up with the air holes 53 form the first fuel nozzle group. Fuel nozzles paired up with the air holes 54 form the second fuel nozzle group.

Fuel jetted from the first fuel nozzle group and the second fuel nozzle group has different levels of fuel dispersion performance relative to air at an outlet cross section of the air hole. In FIG. 2, the fuel at the air holes 54 has a higher fuel dispersion performance than that at the air holes 53 does. The dispersion performance of the fuel refers to how uniformly the fuel disperses at the outlet cross section of the air hole. Consequently, the higher the dispersion performance of the fuel, the more uniform the fuel distribution is at the outlet cross section of the air hole.

Figure 3A:
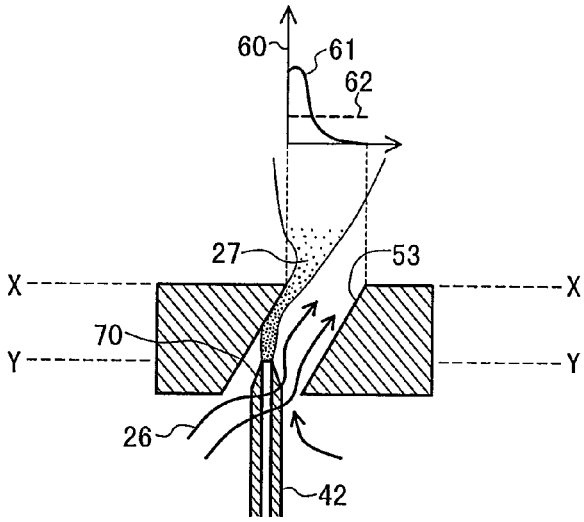
FIG. 3A is a side cross-sectional view showing a tapered fuel nozzle and an air hole, positional relationships therebetween, and a flow of an air jet and a fuel jet according to the first embodiment of the present invention.
Figure 4A:
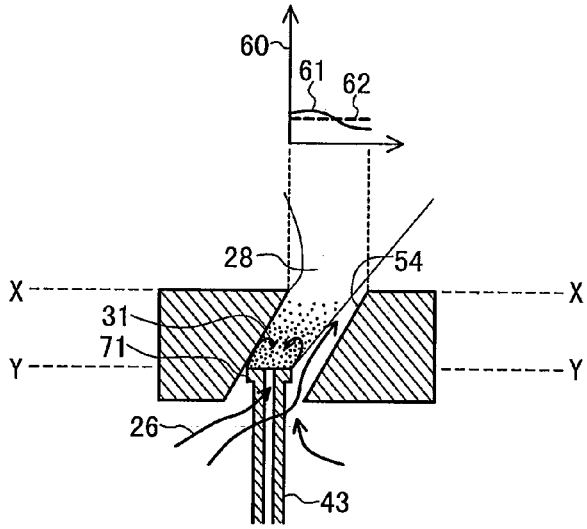
FIG. 4A is a side cross-sectional view showing a ribbed fuel nozzle and an air hole, positional relationships therebetween, and a flow of an air jet and a fuel jet according to the first embodiment of the present invention.

FIGS. 3A and 4A are views showing arrangements of the fuel nozzles and the air hole plates inside the central broken line 52 shown in FIG. 2. Each of the three air holes 53 among others inside the central broken line 52 is paired up with each of the fuel nozzles of the first fuel nozzle group. The fuel nozzle constituting the first fuel nozzle group is a fuel nozzle 42 having a taper 70 at a leading end thereof. Each of the other three air holes 54 inside the central broken line 52 is paired up with each of the fuel nozzles of the second fuel nozzle group. The fuel nozzle constituting the second fuel nozzle group is a fuel nozzle 43 having a rib 71 at a leading end thereof.

FIG. 3A is an enlarged view showing the air hole 53 (constituting the first fuel nozzle group). The fuel nozzle and the air hole are disposed so that an air flow is formed on an outer peripheral side of a fuel flow inside the air hole. A fuel flow 27 jetted from the fuel nozzle 42 collides with a wall surface in the air hole 53. The fuel flow 27 flows along the wall surface of the air hole 53 before being jetted into the chamber 1. Accordingly, jetting from the air hole 53 occurs with mixing of the fuel flow 27 with an air flow 26 not progressing therein.

A graph 60 of FIG. 3A shows fuel concentration distribution at the outlet cross section of the air hole 53. On the graph 60, the abscissa represents position in the air hole outlet and the ordinate represents fuel concentration. A solid line 61 represents the fuel concentration distribution in the fuel nozzle 42, while a broken line 62 represents a fuel concentration when fuel is fully mixed with air. As shown by the solid line 61, fuel is not dispersed at the outlet cross section, producing a local region having a high fuel concentration. Accordingly, jetting into the chamber 1 occurs with the mixing of the air jet and the fuel jet not progressed.

Figure 3B:
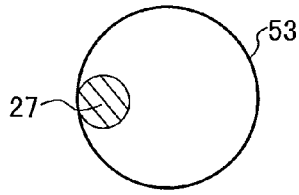
FIG. 3B shows a fuel distribution at cross section X-X (outlet of the air hole) of FIG. 3A.
Figure 3C:
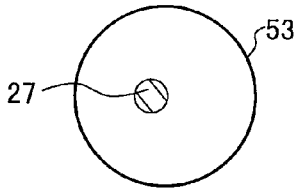
FIG. 3C shows a fuel distribution at cross section Y-Y (fuel hole of the fuel nozzle) of FIG. 3A.

FIG. 3B shows a fuel distribution at cross section X-X (outlet of the air hole) of FIG. 3A. FIG. 3C shows a fuel distribution at cross section Y-Y (fuel hole of the fuel nozzle) of FIG. 3A. The fuel flow immediately following a jet from the fuel hole of the fuel nozzle has a cross-sectional area substantially equal to a cross-sectional area of the fuel hole. In addition, the fuel nozzle is shaped so as not to impede a surrounding air flow, so that the fuel flow penetrates through the air flow to collide with a side wall of the air hole 53. Further, the fuel flow flows unevenly along the side wall of the air hole 53 at the outlet of the air hole 53, too, so that mixing with the air flow does not progress. It is therefore assumed that the fuel flow maintains its shape when jetted into the chamber 1. As a result, the fuel dispersion performance is degraded at the outlet cross section of the air hole.

FIG. 4A is an enlarged view showing the air hole 54 (constituting the second fuel nozzle group). The fuel nozzle 43 has the rib 71 at the leading end thereof (near the fuel hole). The rib 71 is a protrusion disposed on a cylindrical surface of the fuel nozzle 43, preferably causing turbulence to occur in the air flow. The rib 71 generates a vortex 31 of the air flow at the leading end of the fuel nozzle. The vortex 31 agitates fuel and air, rapidly promoting the mixing. As shown in the graph 60, therefore, the fuel concentration distribution 61 forms generally a mild curve at the outlet cross section of the air hole, becoming uniform.

Figure 4B:
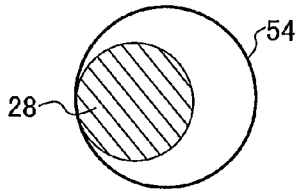
FIG. 4B shows a fuel distribution at cross section X-X (outlet of the air hole) of FIG. 4A.
Figure 4C:
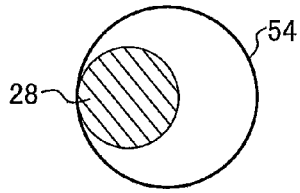
FIG. 4C shows a fuel distribution at cross section Y-Y (fuel hole of the fuel nozzle) of FIG. 4A.

FIG. 4B shows a fuel distribution at cross section X-X (outlet of the air hole) of FIG. 4A. FIG. 4C shows a fuel distribution at cross section Y-Y (fuel hole of the fuel nozzle) of FIG. 4A. A fuel flow 28 jetted from the fuel hole in the fuel nozzle is dispersed by the vortex 31 generated by the functioning of the rib 71 into an area larger than the cross-sectional area of the fuel hole. Further, while the fuel flow 28 flows through the air hole 54, mixing of the fuel flow 28 with the air flow 26 progresses because of the vortex 31 involved therein. Accordingly, fuel is uniformly dispersed at the outlet cross section of the air hole 54, enhancing dispersion performance of the fuel.

A comparison of concentration distribution made between the air hole outlet cross section disposed downstream of the first fuel nozzle 42 and that disposed downstream of the second fuel nozzle 43 reveals the following relationship. Specifically, the fuel flow jetted from the first fuel nozzle 42 is insufficiently mixed with the air flow when being jetted into the chamber 1. As a result, the fuel concentration at the region 27 of FIG. 3B is high, resulting in a higher combustion temperature of the flame formed. Conversely, the fuel flow jetted from the second fuel nozzle 43 is sufficiently mixed with the air flow before being jetted into the chamber 1. As a result, the fuel concentration at the region 28 of FIG. 4B is low, thus preventing the combustion temperature from rising. Accordingly, the fuel concentration of the fuel jet at the outlet cross section of the air hole increases and, as a result, the temperature of the flame formed can be increased, as the dispersion performance of the fuel is made lower.

As described heretofore, by offering different levels of fuel dispersion performance according to the type of the fuel nozzle, different fuel concentrations can be provided of the fuel flow jetted from the corresponding fuel nozzles. Further, the fuel concentration at the region 27 is higher than that at the region 28. This allows the first fuel nozzle 42 to improve flame holding performance.

In particular, if a flame of 1600° C. or higher is formed at the air hole outlet using the fuel flow jetted from the fuel nozzle 42 having a lower fuel dispersion performance, the burner flame can be held to maintain good flame stability.

Figure 5:
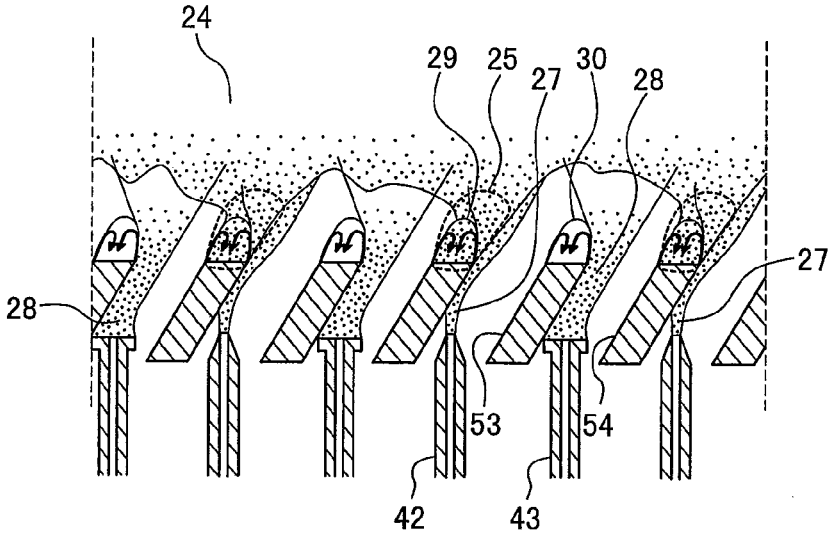
FIG. 5 is a side cross-sectional view showing a relationship among the fuel nozzle, the air hole, the fuel jet, the low flow rate recirculation zone, and the flame according to the first embodiment of the present invention.

FIG. 5 is a developed view showing the air hole plate inside the central broken line 52 developed circumferentially along a curve A shown in FIG. 2. In accordance with the first embodiment of the present invention, the air holes 53, 54 disposed inside the central broken line 52 have a swirl angle. Further, the fuel nozzles 42 having a tapered leading end (constituting the first fuel nozzle group) and the fuel nozzles 43 having a ribbed leading end (constituting the second fuel nozzle group) are alternately disposed. The fuel nozzles 42, 43 are inserted inside the air holes.

As described earlier, with the tapered fuel nozzle 42, the fuel flow and the air flow are jetted in the chamber 1 without being well mixed together. As a result, there is a local region of high fuel concentration at the outlet of the air holes paired up with the corresponding ones of the fuel nozzles of the first fuel nozzle group. Further, a low flow rate recirculation zone 29 is formed near the air hole outlet.

Since the local region of high fuel concentration is adjacent the low flow rate recirculation zone 29, the low flow rate recirculation zone 29 takes in a large amount of fuel. It is then considered that the low flow rate recirculation zone 29 serves as a flame base 25 to hold the flame stably. Mixing of fuel with air is yet to progress particularly at the flame base 25, which helps develop a condition substantially close to diffusion combustion, achieving good flame stability.

It is to be noted that diffusion combustion emits a large amount of NOx. A greater amount of air is, however, supplied to the air holes, for which the first fuel nozzle group supplies fuel, than the air holes, for which the second fuel nozzle group supplies fuel. This produces an effect of reducing NOx generated from the flame base 25. The flame 24 formed downstream of the flame base 25 is lean premix combustion for the progressed mixing of fuel and air. As a result, the amount of NOx produced by the flame base 25 can be minimized.

The second fuel nozzle group comprised of the ribbed fuel nozzles 43, on the other hand, has a high degree of dispersion of fuel at the outlet cross section of the air hole. Fuel and air sufficiently mixed together are therefore jetted from the air hole. Accordingly, fuel is not taken in large amounts in a recirculation flow 30 formed at the air hole outlet. In addition, the fuel and air being mixed uniformly together makes flame propagation speed lower. The flame base 25 is not therefore formed at the outlet of the air hole 54 the second fuel nozzle group has, so that generation of NOx can be suppressed.

As described above, having the first fuel nozzle group and the second fuel nozzle group disposed alternately makes a stable flame formed by the first fuel nozzle group supply a flame formed by the second fuel nozzle group with heat or radicals. This assists a lean premixture jetted from the second fuel nozzle group in combustion to form a single, solid flame 24 on a downstream side, which ensures stable combustion. Because of a certain distance to be covered by the fuel and air jetted from the second fuel nozzle group and the air holes to reach the flame 24, the fuel and air are further mixed together to reduce the amount of NOx emissions.

As described heretofore, the number of flame bases produced to be burning diffusively is limited inside the central broken line 52 and diffusion combustion and premix combustion mutually supplement heat capacity, so that flame combustion stability can be maintained and the amount of NOx emissions can be reduced.

The flame combustion stability can also be improved if there is at least one fuel nozzle having a low fuel dispersion performance relative to one burner, as compared with a case in which all fuel nozzles offer a high fuel dispersion performance.

A comparison is then made of the amount of air flowing in the air hole between the first fuel nozzle group and the second fuel nozzle group. The fuel nozzle 42 has the taper 70 at the leading end thereof, shaped so as not to impede flow of the air flow 26. The rib 71 of the fuel nozzle 43, on the other hand, is disposed so as to plug the inlet to the air hole, thus preventing the air flow 26 from flowing in the air hole. Accordingly, the first fuel nozzle group allows the air to flow in the air hole more easily than the second fuel nozzle group does. Consequently, given the same flow rate of the fuel to be supplied, the first fuel nozzle group results in a lower fuel air ratio. The fuel air ratio is defined by the following equation.

$$\text{Fuel air ratio} = \text{amount of fuel}/\text{amount of air} \quad \text{(Equation 1)}$$

As described earlier, the tapered fuel nozzle (first fuel nozzle group) offers a lower fuel dispersion performance than the ribbed fuel nozzle (second fuel nozzle group) does, tending to produce a greater amount of NOx. The first fuel nozzle group has, however, a lower fuel air ratio than that of the second fuel nozzle group and is thus capable of supplying a greater amount of air to the flame base 25. Accordingly, the amount of NOx emissions generated from the first fuel nozzle group can be suppressed.

Figure 7:
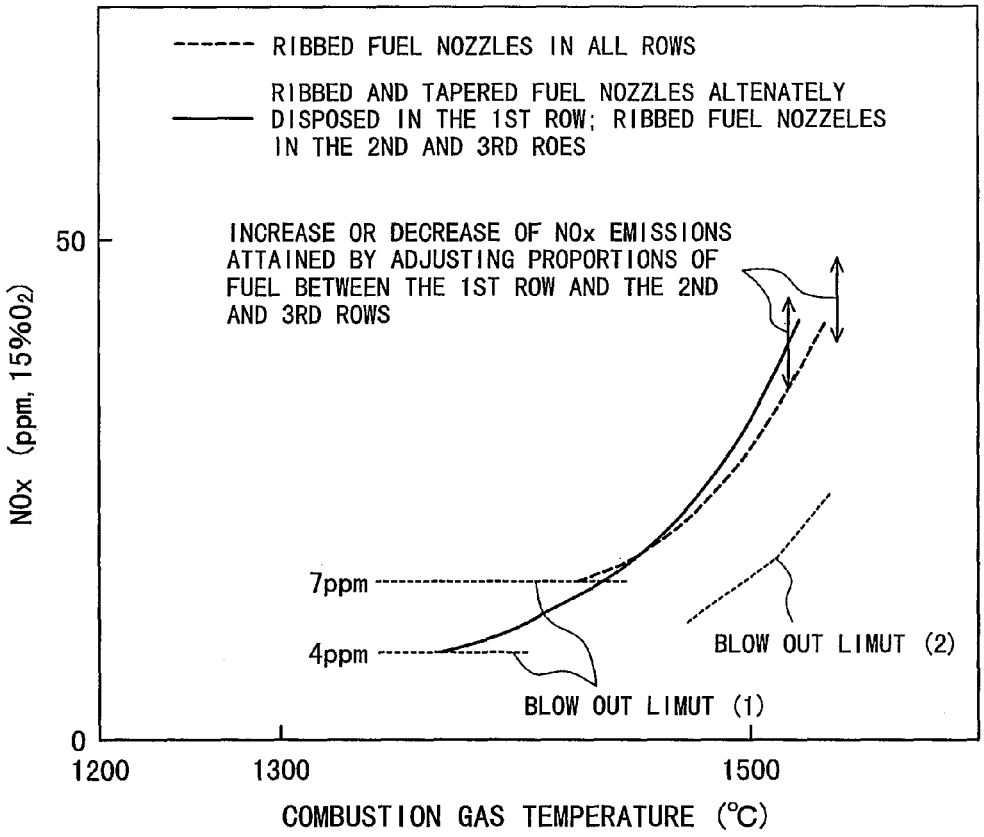
FIG. 7 is a diagram showing a relationship between a combustion gas temperature and NOx.

FIG. 7 is a diagram showing results of a combustion experiment conducted in atmospheric pressure. On the diagram, the abscissa represents combustion gas temperature and the ordinate represents the amount of NOx emissions. The amount of NOx emissions on the ordinate represents values obtain through conversion to conditions equivalent to 15% $O_2$ and an actual machine pressure condition (15 ata). The solid line represents the arrangement of the embodiment of the present invention, the ribbed fuel nozzles and tapered fuel nozzles being alternately disposed on the first row (inside the central broken line 52) and the ribbed fuel nozzles being disposed on the second and third rows. The broken line represents the arrangement, in which the ribbed fuel nozzles are incorporated on the first through third rows. The experiment was conducted by varying the proportion of the fuel supplied to the fuel nozzles between the first row and the second/third row. FIG. 7 shows typical experimental results.

Varying the proportion of the fuel supplied results in the amount of NOx emissions relative to the combustion temperature being varied as shown in FIG. 7. With a blow out limit (1) in a given combustion temperature or less, however, the amount of NOx emissions remains substantially the same. The reason for the large amount of NOx emissions with a blow out limit (2) is as follows. Specifically, reducing the proportion of fuel for the first row for the reduced amount of NOx emissions resulted in an excessively low fuel flow rate, which drastically reduced the flame stability. On the other hand, entire combustion temperature is high, so that NOx Reduction is limited.

For the arrangement having only the ribbed fuel nozzles (the broken line), the amount of NOx emissions at the blow out limit (1) is about 7 ppm. In accordance with the arrangement of the embodiment of the present invention, in which the ribbed fuel nozzles and the tapered fuel nozzles are alternately disposed on the first row (the solid line), the amount of NOx emissions at the blow out limit (1) can be reduced down to 4 ppm.

Generally, the amount of NOx emissions and the flame stability have a trade-off relationship with each other. A smaller amount of NOx emissions relative to a given combustion temperature results in a lower flame stability. Accordingly, the combustion temperature at a blow out point increases, thus limiting the amount of NOx emissions at the blow out limit. The flame stability and the low NOx combustion can both, however, be achieved by the embodiment of the present invention. Reduction in the flame stability with even lower NOx emissions can be prevented, thereby allowing the flame to be held.

The air holes inside the central broken line 52 may also be disposed on an ellipse.

Figure 25:
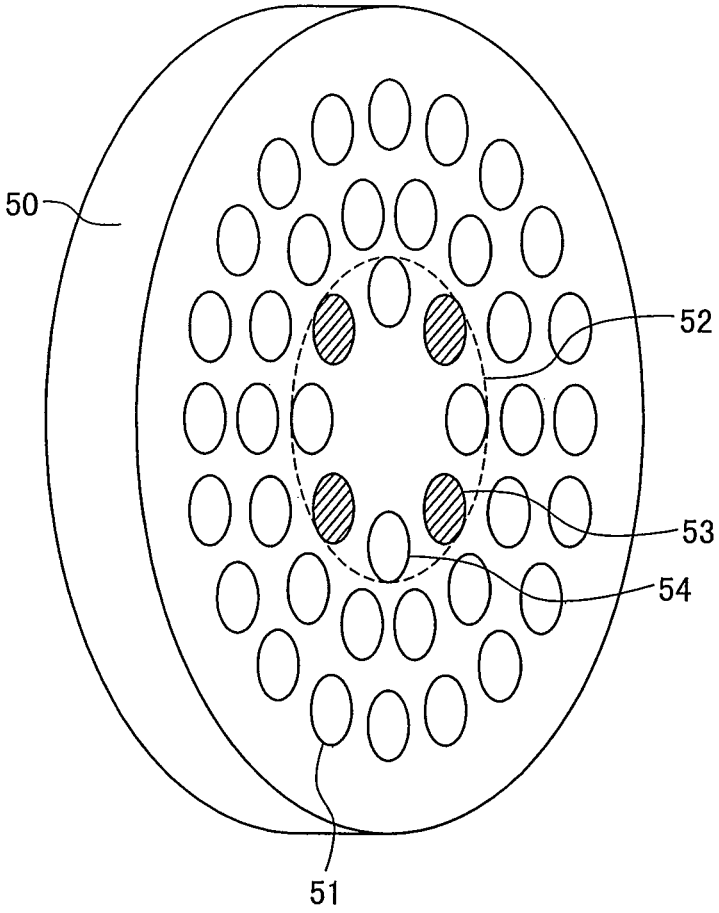
FIG. 25 is an end view showing the burner according to the first embodiment of the present invention.
Figure 26:
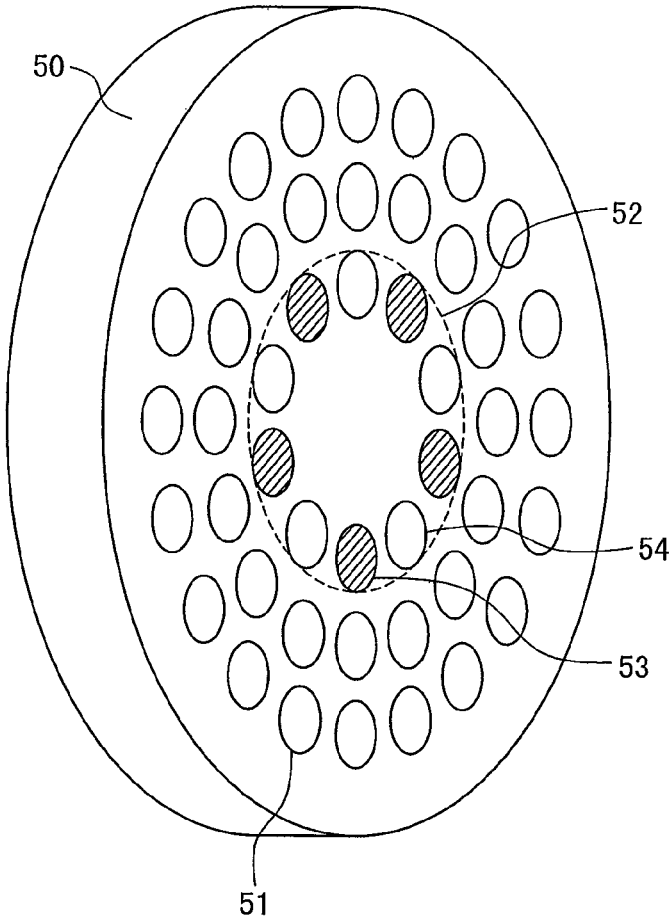
FIG. 26 is an end view showing the burner according to the first embodiment of the present invention.

Preferably, the central broken line 52 is made to have a larger radius to dispose the air holes on the first row closer to the outer peripheral side in order to enlarge the flame holding region for greater flame stability, as shown in FIGS. 25 and 26. In this case, the number of air holes on the first row is increased to 8 or 10 to thereby increase the swirl flow. The swirl flow can thereby be stabilized and strengthened for an even more stabilized flame. It goes without saying, however, that the number of air holes on the first row is not limited to 8 or 10.

Under an operating condition, in which a power generation load of the gas turbine is low and the fuel air ratio of the entire combustor is low, it is necessary to supply a sufficient amount of fuel so that the flame base 25 can hold the entire flame. There are two separate fuel supply systems as shown in FIG. 1. Even under the condition of a low fuel air ratio of the entire combustor, therefore, the amount of fuel supplied from the fuel supply system 12 to the fuel nozzles paired up with the air holes inside the central broken line 52 is maintained at a predetermined level, so that a stable flame can be held under a wide range of operating conditions.

Depending on certain operating conditions, the jet jetted from one of the air holes disposed inside the central broken line 52 may have a fuel air ratio higher than that of the jet jetted from one of the air holes disposed outside the central broken line 52. This case does not, however, result in an increased amount of NOx emissions thanks to the low fuel air ratio of the entire combustor. Such an operating method is effective in other embodiments.

Second Embodiment

Figure 8:
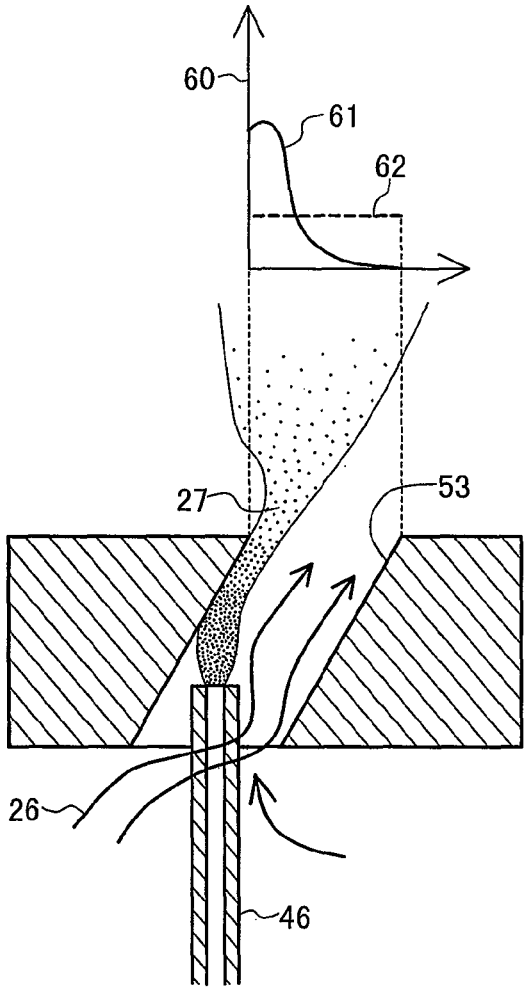
FIG. 8 is a view showing a typical fuel nozzle constituting the embodiment of the present invention.

An example of the fuel nozzle, which offers a low fuel dispersion performance at the outlet cross section of the air hole, will be described. Referring to FIG. 8, a fuel nozzle 46 is a straight pipe having a small outside diameter and a leading end not machined. The fuel nozzle 46 has a thin wall. The fuel nozzle 46 offers degraded dispersion performance of fuel and air because of no severe turbulence occurring at a leading end thereof. As a result, there is a local region having a high fuel concentration at the air hole outlet as shown in a graph 60 of FIG. 8. In addition, the arrangement of narrowing the diameter than in the fuel nozzle supplying fuel to the air holes outside the central broken line allows a greater amount of air to flow into the air hole.

Figure 9:
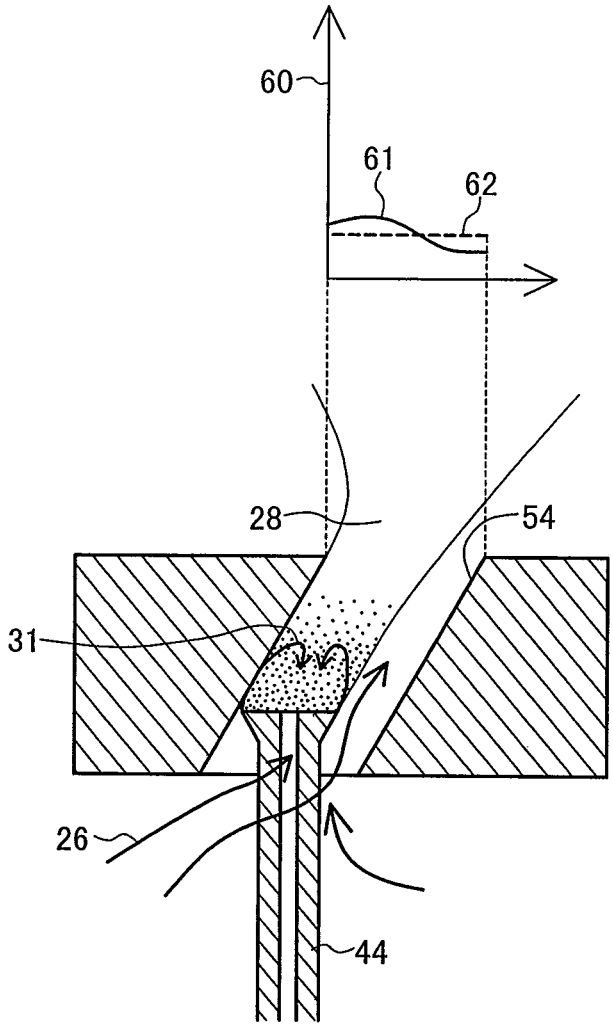
FIG. 9 is a view showing a typical fuel nozzle constituting the embodiment of the present invention.
Figure 10:
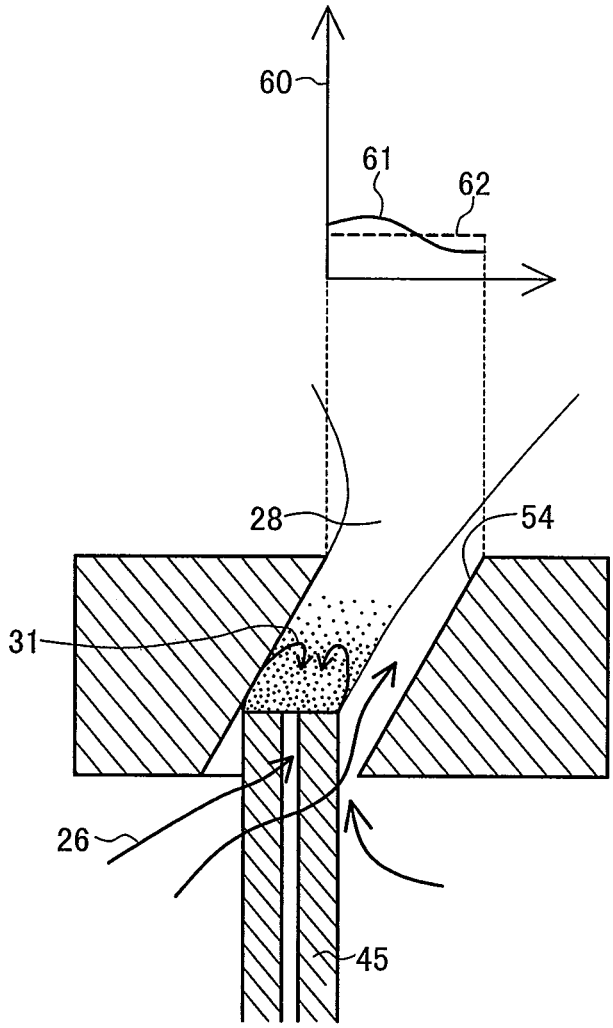
FIG. 10 is a view showing a typical fuel nozzle constituting the embodiment of the present invention.

Examples of fuel nozzles, which offer a high fuel dispersion performance at the outlet cross section of the air hole, will be described. FIGS. 9 and 10 are enlarged views showing fuel nozzles and air holes.

Referring to FIG. 9, a fuel nozzle 44 has a leading end having its tip extended outwardly. As with the ribbed fuel nozzle 43, the leading end of the fuel nozzle 44 forms a large vortex 31. Turbulence generated by the vortex 31 promotes mixing of the fuel and air, thus evening out the fuel concentration at the air hole outlet.

FIG. 10 is a view showing a fuel nozzle 45 of a straight pipe shape having an outside diameter larger than the fuel nozzle 44 shown in FIG. 9 and a leading end not machined. Because the fuel nozzle 45 has a thick wall, a large vortex 31 is formed at the leading end of the fuel nozzle 45 shown in FIG. 10, so that the fuel can be mixed well with the air. As shown in a graph 60 of FIG. 10, the fuel concentration is evened out at the outlet cross section of the air hole.

Figure 11:
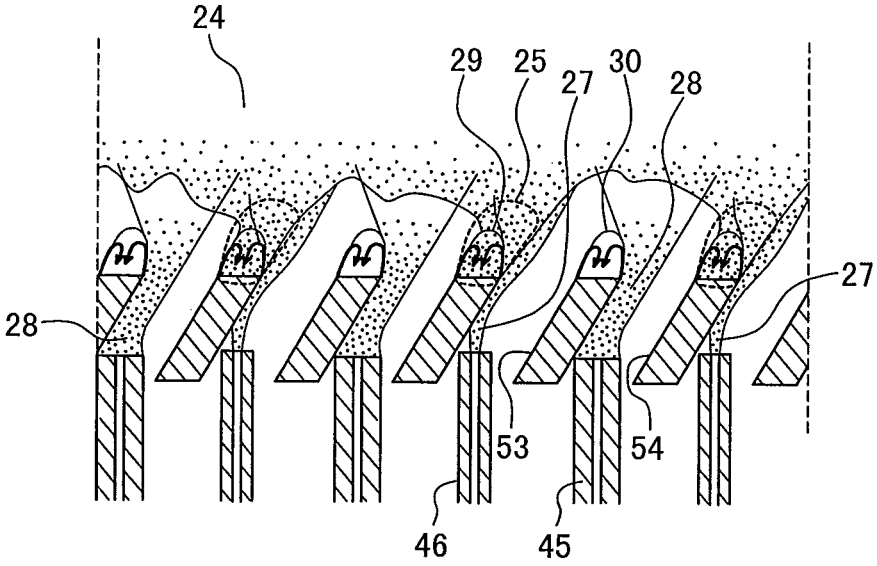
FIG. 11 is a side cross-sectional view showing a relationship among a fuel nozzle, an air hole, a fuel jet, a low flow rate recirculation zone, and a flame to be formed according to a second embodiment of the present invention.

FIG. 11 is a developed view showing the air hole plate inside the central broken line 52 developed circumferentially. In accordance with the second embodiment of the present invention, two different types of fuel nozzles are used to make up a total of six. Specifically, three of the six fuel nozzles are the fuel nozzles 46 of a straight pipe shape having the small outside diameter and the leading end not machined and the remaining three are the fuel nozzles 45 of a straight pipe shape having the large outside diameter and the leading end not machined. The fuel nozzles 46 and the fuel nozzles 45 are disposed alternately.

A first fuel nozzle group having the fuel nozzles 46 includes a region in which the fuel and air is mixed only poorly and fuel is locally richer. Further, the fuel flow 27, in which mixing with air does not progress, adjoins the low flow rate recirculation zone 29 around the air hole outlet. This allows the flame to be stably held with the low flow rate recirculation zone 29 as a base point. A greater amount of air tends to flow in as compared with the other type of fuel nozzle. This helps make mixing of the fuel and air progress in a zone downstream of the flame base 25, achieving lean premix combustion.

In a second fuel nozzle group having the fuel nozzles 45, on the other hand, mixing of the fuel with air progresses in the air hole, so that no flame base 25 is formed in the low flow rate recirculation zone 30 near the air hole outlet. A premixture of the fuel and air well mixed together undergoes stable premix combustion thanks to the stable flame formed by the first fuel nozzle group, thus contributing to reduction in NOx emissions.

The second embodiment of the present invention also combines the stable combustion by the flame base 25 with the lean premix combustion to form a single flame 24, simultaneously achieving both flame stabilization and low NOx combustion.

Third Embodiment

Figure 12:
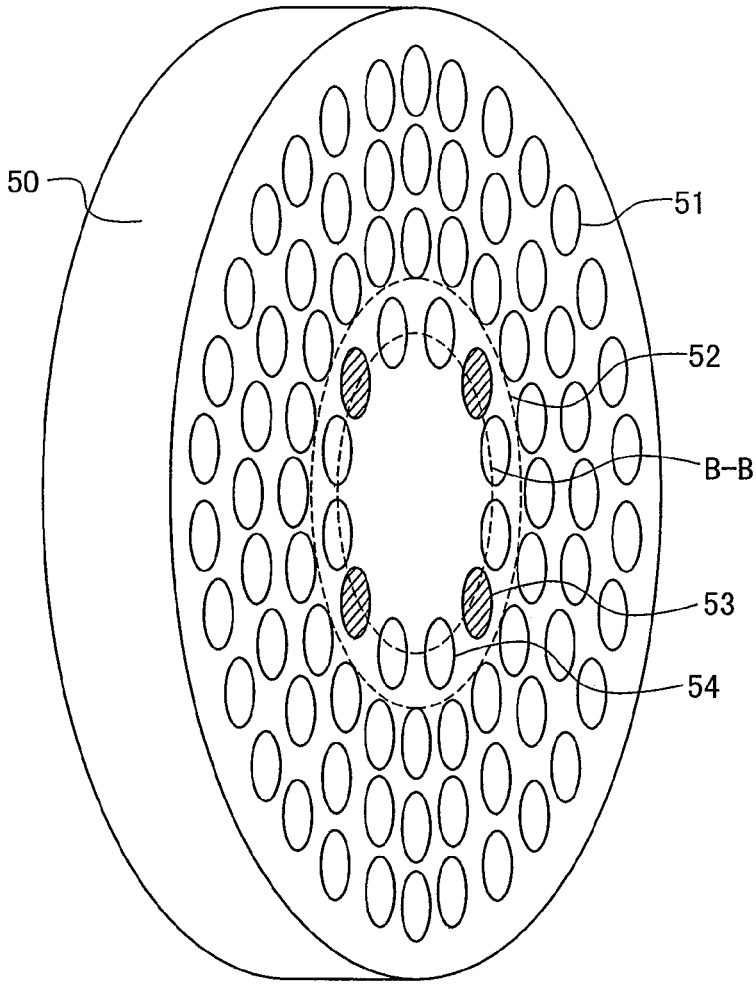
FIG. 12 is an end view showing a burner according to a third embodiment of the present invention.

In comparison with the first embodiment of the present invention, the arrangement according to a third embodiment of the present invention includes an air hole plate having a larger radius and there are four rows of air holes disposed radially. FIG. 12 is a view showing only an air hole plate 50 that is a burner end face of the combustor.

An air hole 53 inside a central broken line 52 is paired up with a tapered fuel nozzle 42 and a first fuel nozzle group comprised of the tapered fuel nozzles 42 has low fuel dispersion performance. As a result, there is a local region of high fuel concentration at an outlet of the air hole 53. An air hole 54 inside the central broken line 52, on the other hand, is paired up with a ribbed fuel nozzle 43 and a second fuel nozzle group comprised of the ribbed fuel nozzles 43 has high fuel dispersion performance. Accordingly, fuel concentration distribution is uniform at the outlet of the air hole 54.

In accordance with the third embodiment of the present invention, the combustor itself is large in body, which makes large the air hole plate. To form an even more stable and larger swirl flow, therefore, a swirl region inside the central broken line 52 is enlarged diametrically to accommodate an increased number of air holes. To reduce the number of flame bases produced to be burning diffusively and emitting a relatively large amount of NOx emissions, it is herein preferable that one of the fuel nozzles belonging to the first fuel nozzle group are disposed for every third fuel nozzle.

Figure 13:
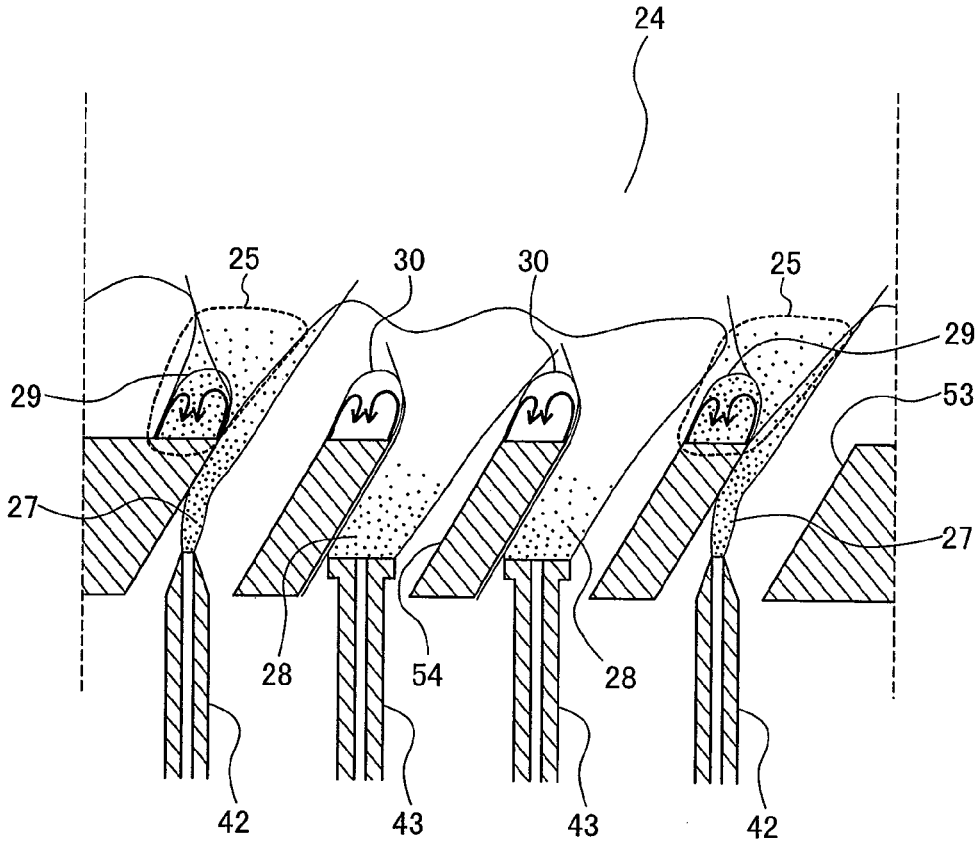
FIG. 13 is a side cross-sectional view showing a relationship among a fuel nozzle, an air hole, a fuel jet, a low flow rate recirculation zone, and a flame to be formed according to the third embodiment of the present invention.

FIG. 13 is a developed view showing the air hole plate inside the central broken line 52 developed circumferentially along a curve B-B shown in FIG. 12. Fuel jetted from the second fuel nozzle group can burn stably thanks to the stable flame formed by the adjoining second fuel nozzle group. The fuel nozzles may also be disposed irregularly, and not regularly.

Figure 14:
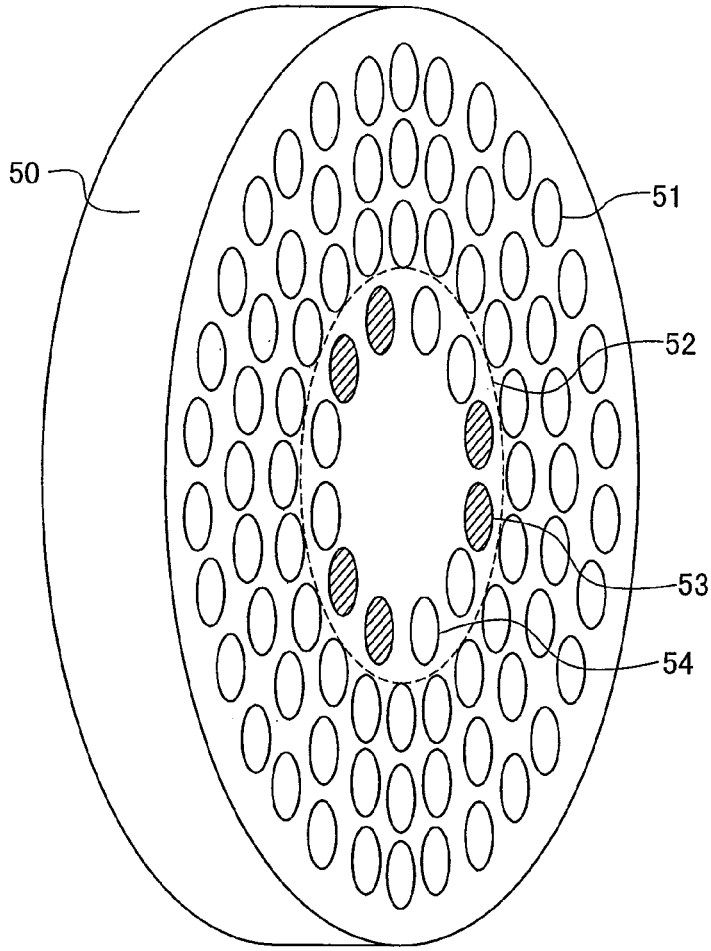
FIG. 14 is an end view showing a typical burner according to the third embodiment of the present invention.

To promote local flame stability, it is also possible to dispose the fuel nozzles in the first fuel nozzle group, which have low mixing performance, adjacent to each other as shown in FIG. 14. It should, however, be noted that an increased number of fuel nozzles in the first fuel nozzle group results in an increased amount of NOx emissions. Conversely, an excessively small number of fuel nozzles in the first fuel nozzle group results in heat or radicals not being sufficiently supplied to the fuel jetted from the fuel nozzles in the second fuel nozzle group, leading to reduced flame stability.

The number and the position of the diffusively burning flame bases 25 can be finely adjusted by simply changing the shape of the fuel nozzles disposed inside the central broken line, without radically changing the burner structure. If the combustor according to the embodiments of the present invention is applied to a gas turbine, needs exist to use as the fuel an extremely combustible gas, such as a mixed gas of dimethyl ether and hydrogen, and a low calorific value gas, in addition to natural gas. There is therefore a need for burning the above-cited types of gas stably and to produce low NOx emissions. Gas composition greatly affects properties of the flame to be formed. Consequently, flame stability can be enhanced or low NOx emissions can be promoted by simply changing the shape of the fuel nozzles disposed inside the central broken line, without radically changing the burner structure. It is therefore possible to respond to fuels of various types easily.

With a highly reactive fuel with fast burning velocity, such as hydrogen, fuel dispersion performance in the first fuel nozzle group can be improved by a method other than adjusting the number of flame bases 25. For the highly reactive fuel with fast burning velocity, the dispersion performance of fuel and air may be reduced and there is no need of diffusive combustion. This is because of the following reason. Specifically, if there is left only one part of fuel rich region, a flame base 25 is formed to achieve a required burning velocity. It is accordingly possible to achieve further reduction in the amount of NOx emissions, while establishing the flame base 25 required for stably holding the entire flame.

As described above, in accordance with the third embodiment of the present invention, for fuels of various types, part of the fuel nozzle shape is changed and the dispersion performance of the fuel nozzle forming the flame base is adjusted to vary the intensity (size) of the flame base, thereby responding to the fuels of a large variety of types.

Fourth Embodiment

Figure 15:
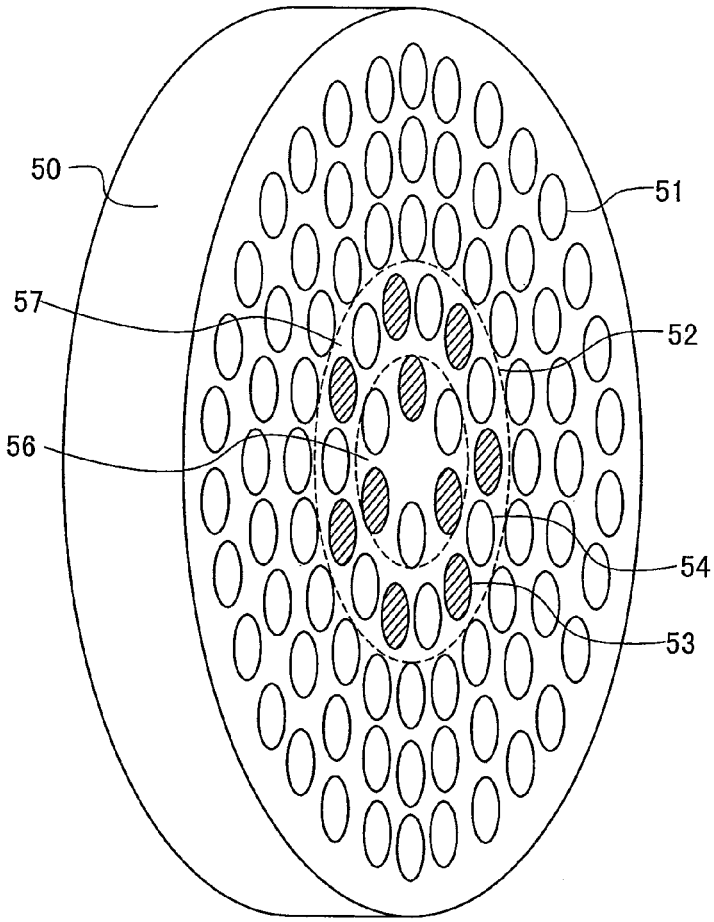
FIG. 15 is an end view showing a burner according to a fourth embodiment of the present invention.

FIG. 15 is a view showing an air hole plate according to a fourth embodiment of the present invention. In comparison with the third embodiment of the present invention, the arrangement according to the fourth embodiment of the present invention has additional two rows of air holes disposed radially inside the central broken line 52 to strengthen the swirl flow. In the fourth embodiment of the present invention, an air hole 53 is paired up with a tapered fuel nozzle 42 and a first fuel nozzle group comprised of the tapered fuel nozzles 42 has low fuel dispersion performance. An air hole 54 inside the central broken line 52, on the other hand, is paired up with a ribbed fuel nozzle 43 and a second fuel nozzle group comprised of the ribbed fuel nozzles 43 has high fuel dispersion performance. The fuel nozzles in the first fuel nozzle group and the fuel nozzles in the second fuel nozzle group are alternately disposed on an upstream side of both first row air holes 56 and second row air holes 57.

In the fourth embodiment of the present invention, there is a large number of diffusively burning flame bases 25, which makes the fourth embodiment disadvantageous in terms of the amount of NOx emissions. Because of the air hole plate 50 having a large radius, however, flame stability in the flame holding region can be improved if there is a need for forming an even larger flame. If the air hole plate 50 has a larger radius to increase a resultant combustion amount in regions other than the flame base 25, the amount of NOx emissions generated from the flame base 25 is relatively decreased. Accordingly, the amount of NOx emissions can generally be reduced to a low level.

Figure 16:
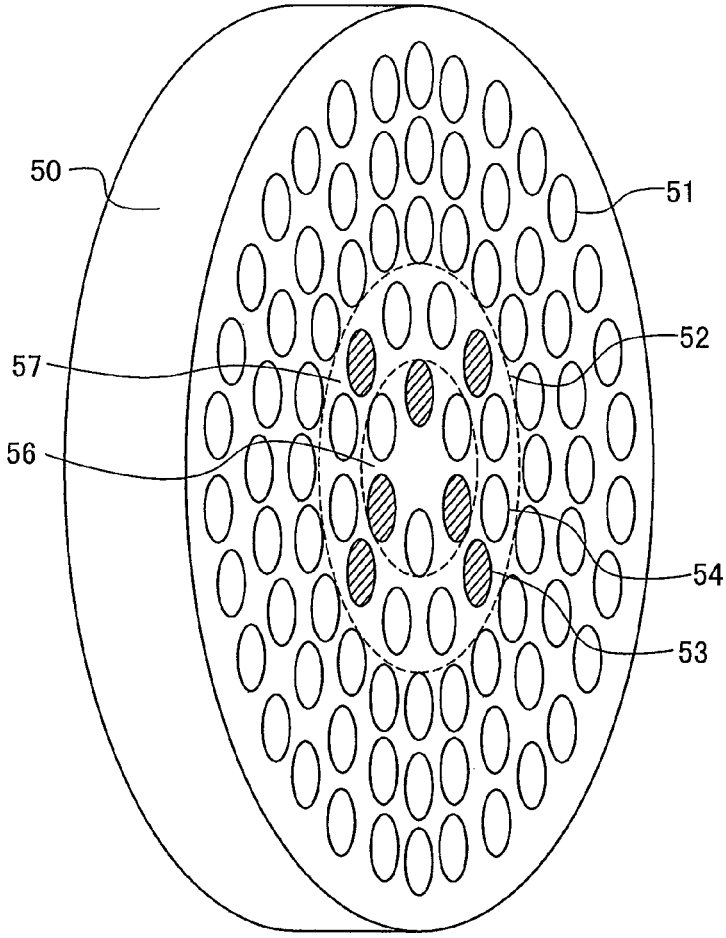
FIG. 16 is an end view showing a typical burner according to the fourth embodiment of the present invention.

Referring to FIG. 16, the fuel nozzles in the first fuel nozzle group having low fuel dispersion performance may be disposed for every third and fourth fuel nozzles in the second row air holes 57. This decreases the number of diffusively burning flame bases 25, so that even further reduction in the amount of NOx emissions can be achieved. In addition, stable combustion can still be made even with the reduced number of flame bases 25 in the second row, since heat or radicals are supplied also from the flame base 25 in the first row.

Figure 17:
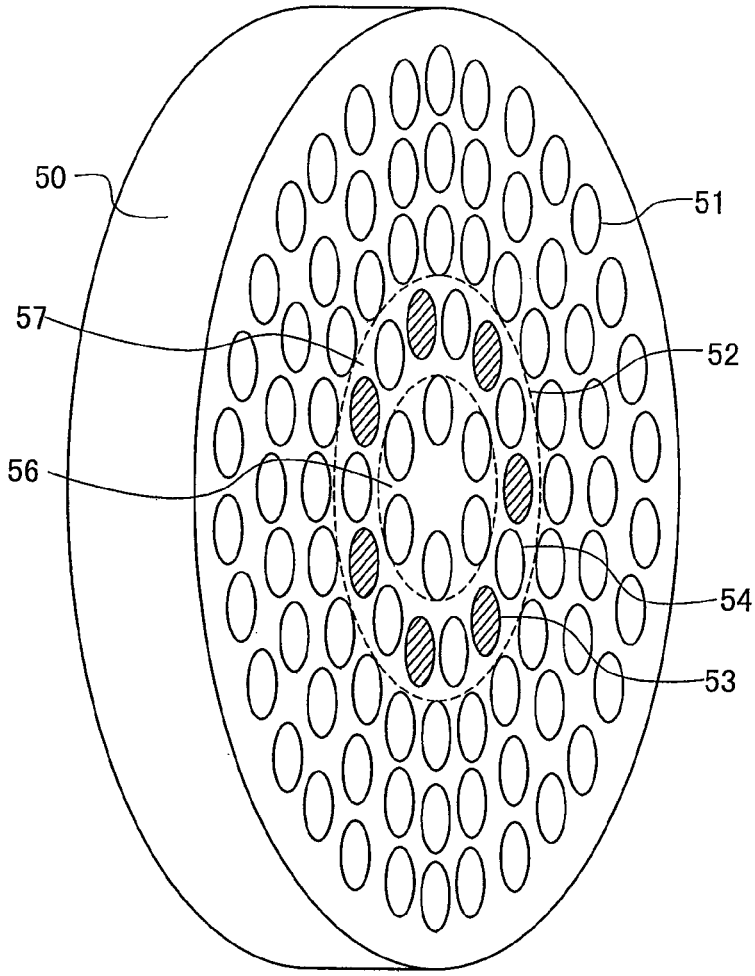
FIG. 17 is an end view showing a typical burner according to the fourth embodiment of the present invention.

Referring further to FIG. 17, all of the first row air holes 56 may be paired up with the fuel nozzles in the second fuel nozzle group having high fuel dispersion performance. Fuel jetted from the first row air holes 56 is stably burned thanks to the heat or radicals transmitted from the flame bases 25 formed by the fuel nozzles in the first fuel nozzle group disposed on the second row. As compared with the arrangement shown in FIG. 16, the arrangement shown in FIG. 17 has a smaller number of diffusively burning flame bases 25, which makes the arrangement shown in FIG. 17 advantageous in terms of low NOx combustion. Further, as compared with the arrangement shown in FIG. 16, the arrangement shown in FIG. 17 has the flame base 25 disposed on the second row, which makes it easier to supply heat or radicals to the fuel jetted from the air holes in the third to fifth rows. This improves stability of the entire flame.

Fifth Embodiment

The arrangement according to the fifth embodiment of the present invention differs from the arrangement according to the first embodiment of the present invention in that the fuel nozzles in the first fuel nozzle group having low fuel dispersion performance are used for the air holes disposed outside the central broken line 52, in addition to the air holes disposed inside the central broken line 52.

Figure 18:
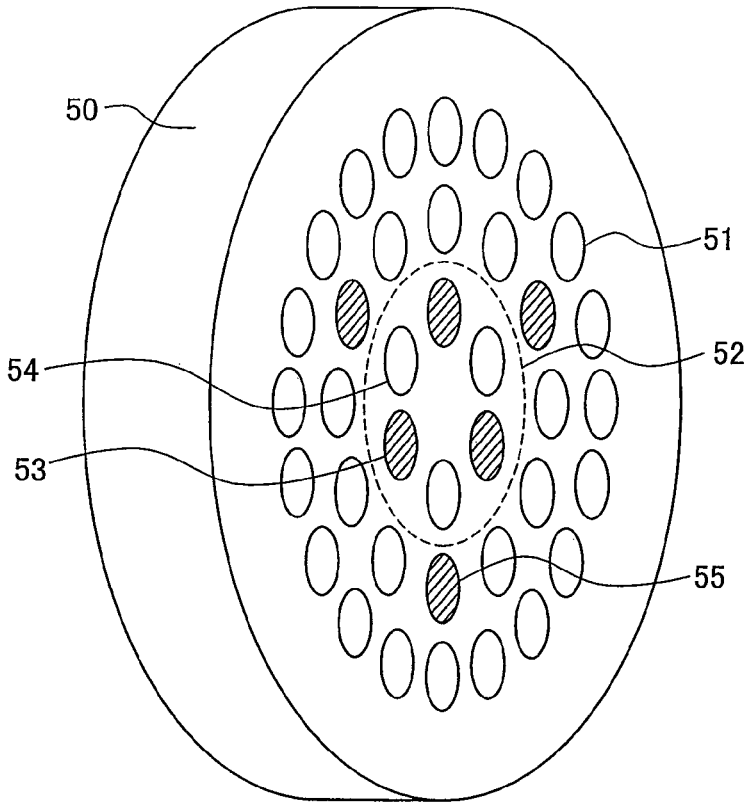
FIG. 18 is an end view showing a burner according to a fifth embodiment of the present invention.
Figure 19:
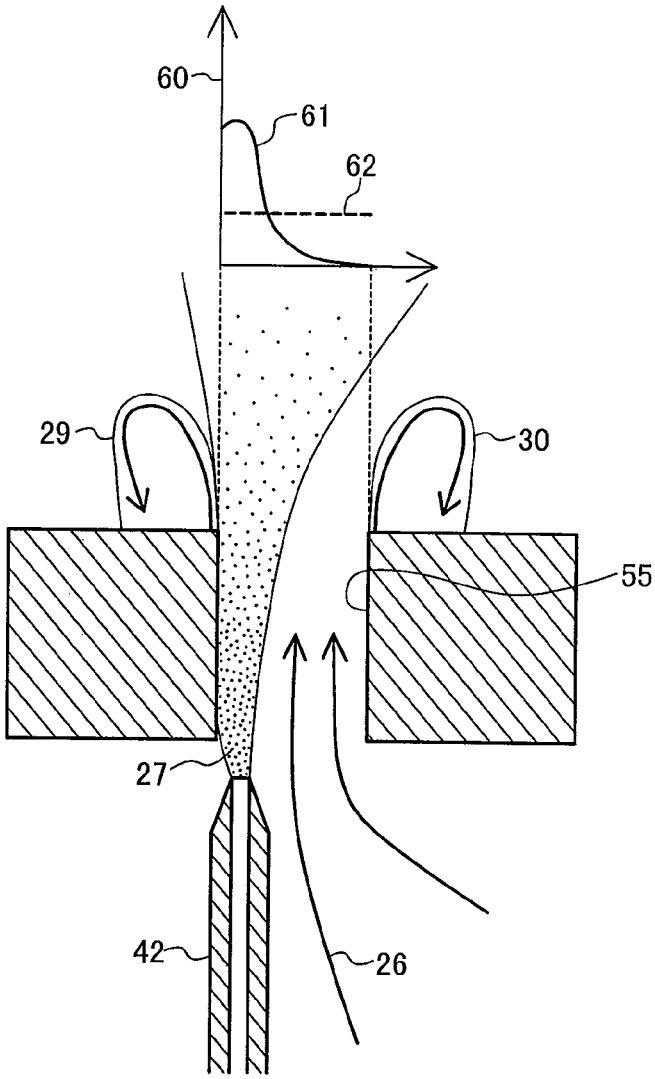
FIG. 19 is a side cross-sectional view showing a fuel nozzle and an air hole, positional relationships therebetween, and a flow of an air jet and a fuel jet according to the fifth embodiment of the present invention.

FIG. 18 is an enlarged view showing an air hole plate according to the fifth embodiment of the present invention. FIG. 19 is an enlarged view showing an air hole 55. The air hole 55 does not have a swirl angle and is paired up with a fuel nozzle 42 having a taper 70 at a leading end thereof. The air hole 55 has a center axis offset from a center axis of the fuel nozzle 42. Further, the leading end of the fuel nozzle 42 is not inserted in the air hole 55.

In the first fuel nozzle group shown in FIG. 19, no turbulence occurs at the leading end of the fuel nozzle 42. Because the fuel jet is offset relative to the air flow, mixing of the fuel with air does not progress. Accordingly, as shown by a graph 60, there is left a local region of high fuel concentration at the air hole outlet and thus the fuel dispersion performance at the outlet cross section of the air hole is low. Further, the fuel flow adjoins the low flow rate recirculation zone 29 at the air hole outlet. This allows the fuel to be taken in the low flow rate recirculation zone 29, so that the flame is formed with the low flow rate recirculation zone 29 as an origin.

The arrangement according to the fifth embodiment of the present invention, in which the fuel nozzles having low fuel dispersion performance are disposed outside the central broken line 52, increases the number of stably burning flame bases 25. Flame combustion stability can thereby be improved.

Sixth Embodiment

Figure 20:
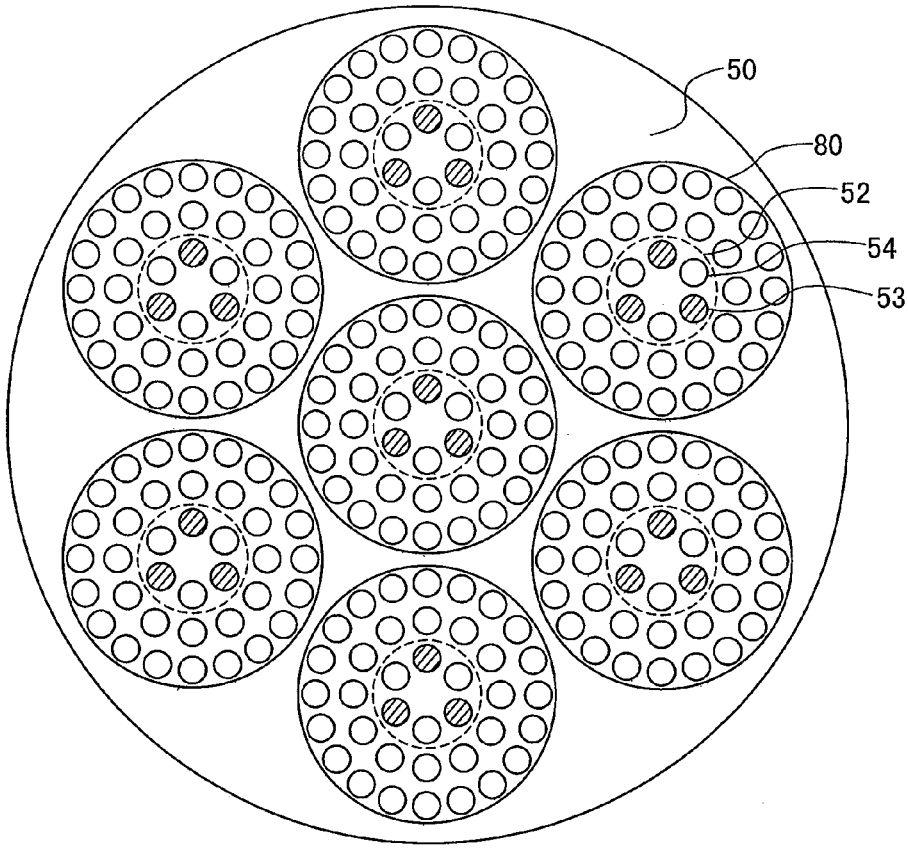
FIG. 20 is an end view showing a burner according to a sixth embodiment of the present invention.

FIG. 20 is a view showing a burner face according to a sixth embodiment of the present invention. The arrangement according to the sixth embodiment of the present invention includes a plurality of sector burners 80 disposed in a set pattern, each of the sector burners 80 being the burner according to the first embodiment of the present invention. In each of the sector burners 80, air holes 53, 54 inside a central broken line 52 have swirl angles and the fuel nozzles in the first fuel nozzle group and the fuel nozzles in the second fuel nozzle group are alternately disposed. Accordingly, a flame is formed in each of the sector burners 80. Control can be easily provided according to combustion load by changing the number of flames formed by the sector burners 80.

Figure 27:
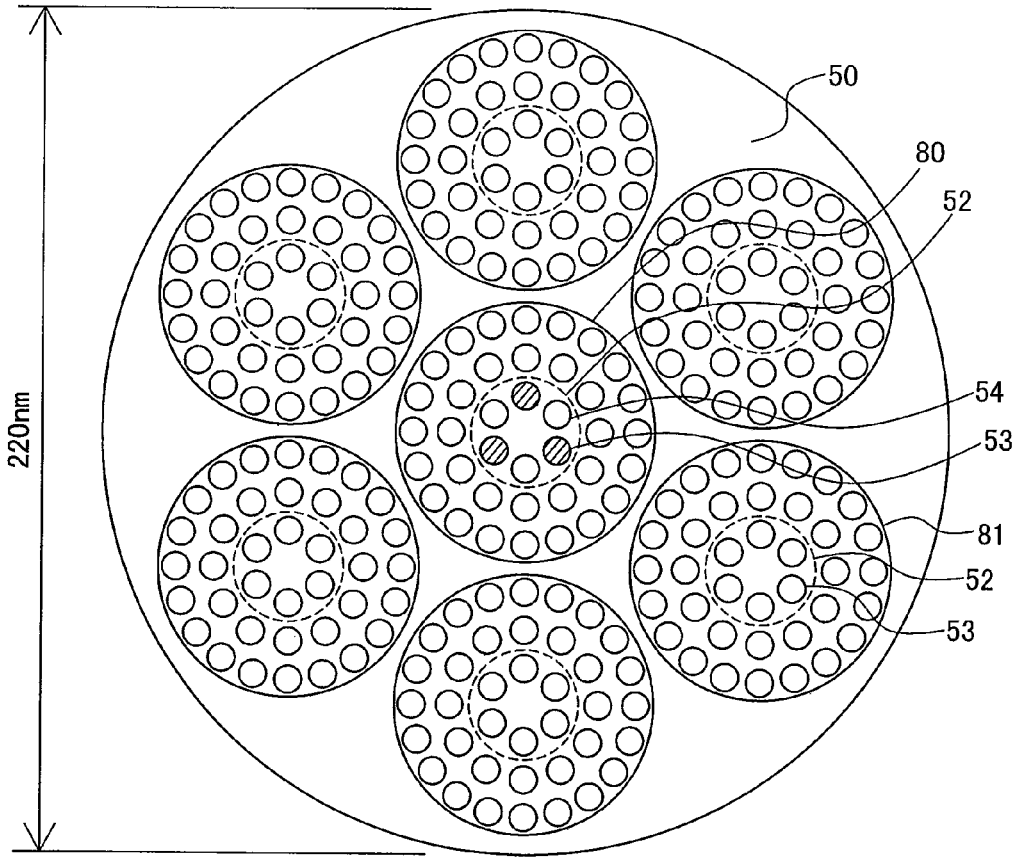
FIG. 27 is an end view showing the burner according to the sixth embodiment of the present invention.

FIG. 27 is a view showing an arrangement, in which only the fuel nozzles in the second fuel nozzle group (ribbed fuel nozzles) are disposed on the center one row in each of the six outer peripheral sector burners 81 of the total of seven. Referring back to FIG. 7, if only the fuel nozzles having high fuel dispersion performance (the fuel nozzles in the second fuel nozzle group) are disposed in a single sector burner, the amount of NOx emissions at the blow out limit becomes higher than the arrangement of the first embodiment of the present invention. The arrangement including the plurality of sector burners 81 disposed in a set pattern according to the sixth embodiment of the present invention allows a central sector burner 80 to supply heat and radicals to the sector burners 81 surrounding the central sector burner 80. This improves flame stability as compared with the sector burner 81 burning independently. In comparison with the arrangement shown in FIG. 20, therefore, the flame stability can better be maintained and even further reduction in the amount of NOx emissions can be achieved for the adoption of only the fuel nozzles in the second fuel nozzle group in the outer peripheral sector burners. The burner shown in FIG. 27 has a diameter of 220 mm and each of the sector burners has a diameter of about 70 mm.

Figure 28:
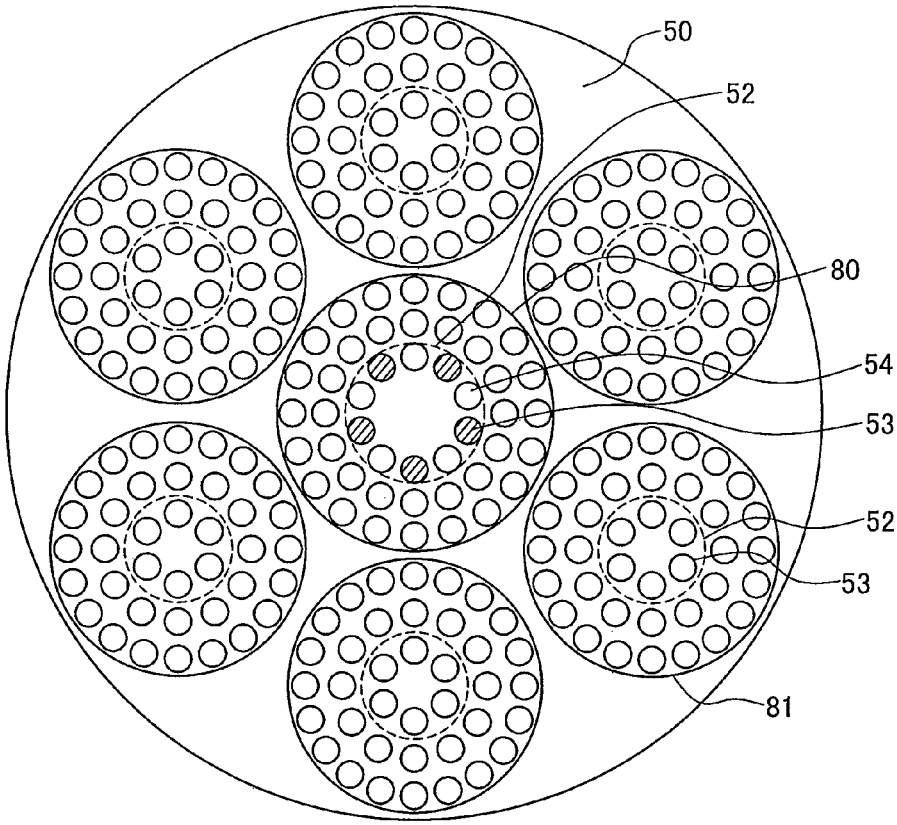
FIG. 28 is an end view showing the burner according to the sixth embodiment of the present invention.

FIG. 28 is a view showing an arrangement, in which the area surrounded by air holes in the first row is wider in a central sector burner 80. The greater area of the flame holding region disposed at the central portion of the central sector burner 80 as in the arrangement of FIG. 28 improves flame stability of the central sector burner itself. In addition, the amount of heat and radicals supplied by the central sector burner to the peripheral sector burners increases, which improves flame stability of the entire burner.

Seventh Embodiment

Figure 21:
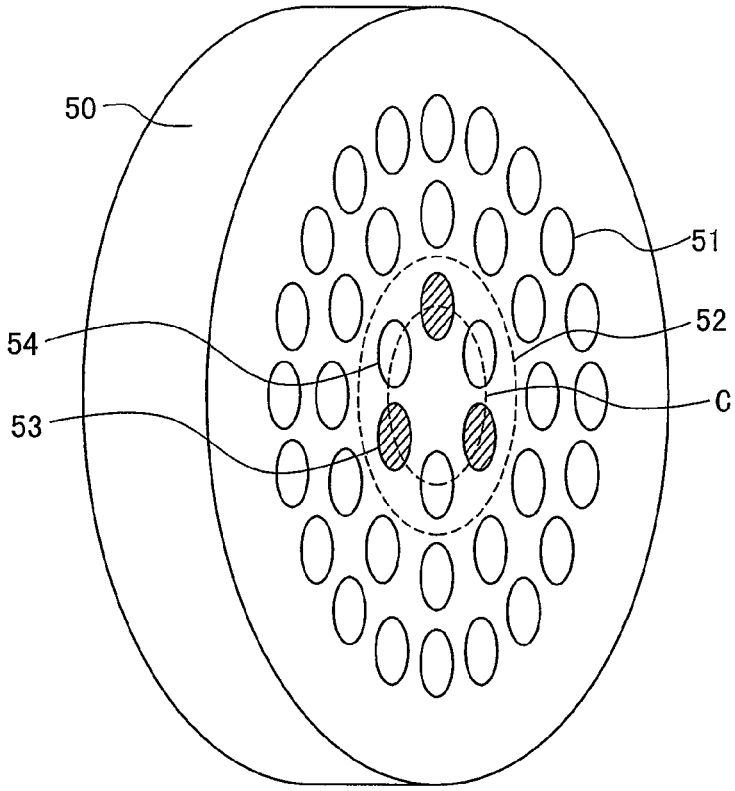
FIG. 21 is an end view showing a burner according to a seventh embodiment of the present invention.
Figure 22:
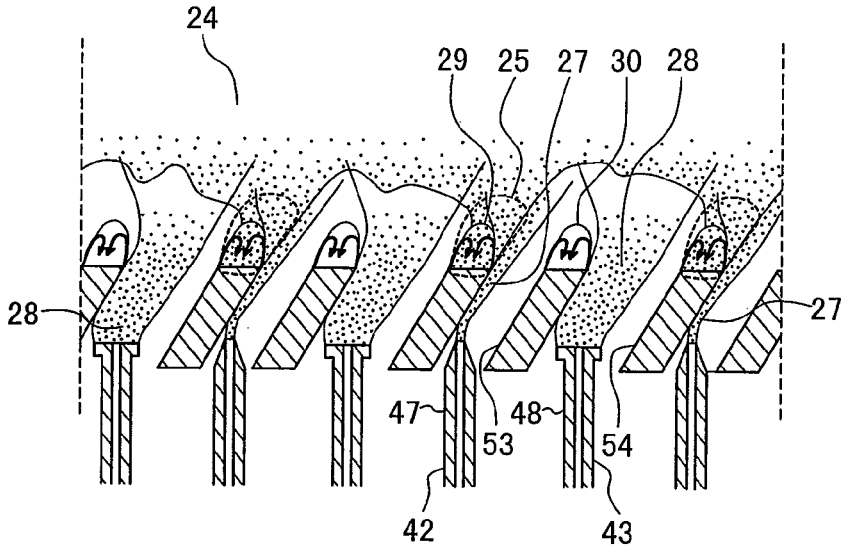
FIG. 22 is a side cross-sectional view showing a fuel nozzle and an air hole, positional relationships therebetween, and a flow of an air jet and a fuel jet according to the seventh embodiment of the present invention.

FIG. 21 is an end view showing a burner. In accordance with a seventh embodiment of the present invention, an air hole 53 (the first fuel nozzle group) has a diameter smaller than that of other air holes. Further, an internal flow path 47 of a fuel nozzle 42 has a small diameter. FIG. 22 is a developed view showing an air hole plate disposed inside a central broken line 52 developed circumferentially (along a curve C shown in FIG. 21).

Because the air hole 53 has a diameter smaller than that of other air holes, the amount of an air flow 26 flowing into the air hole 53 can be reduced. Further, the internal flow path 47 of the fuel nozzle 42 has a diameter smaller than that of an internal flow path 48 of a fuel nozzle 43. The fuel flow rate supplied by one fuel nozzle 42 to the air hole 53 is thereby made smaller than the fuel flow rate supplied by another fuel nozzle 43 to a corresponding air hole.

At this time, the amount of air flowing in the air hole 53 and the amount of fuel jetted from the fuel nozzle 42 are smaller as compared with those of other air holes and fuel nozzles. As a result, the combustion amount of the flame base 25 is smaller than the combustion amount of the flame 24. The amount of NOx emissions from the entire combustor can therefore be kept to a low level. The number of flame bases 25 remains the same and there is little likelihood that the flame stability will be impaired largely. The seventh embodiment is effective in the same manner as in other embodiments of the present invention.

The method for having a reduced fuel flow rate supplied per fuel nozzle for the first fuel nozzle group having low fuel dispersion performance and a locally high fuel concentration at the air hole outlet, as compared with the fuel flow rate supplied per fuel nozzle for the second fuel nozzle group having high fuel dispersion performance and an evened out fuel concentration distribution at the air hole outlet is also effective in other embodiments. Even further reduction in the amount of NOx emissions can be achieved by reducing the fuel flow rate supplied to the first fuel nozzle group forming the flame base and thereby reducing the flame base.

In accordance with the seventh embodiment of the present invention, the air hole 53 for forming the flame base 25 inside the central broken line 52 has a diameter smaller than that of the other air holes. The amount of air flow flowing into the air hole 53 is thereby reduced. The same effect can nonetheless be achieved even with a broader fuel nozzle to be paired up with the air hole 53. The fuel nozzle should further be adapted to have a taper at the leading end thereof to prevent an air recirculation flow from being formed at the leading end.

Eighth Embodiment

Figure 23:
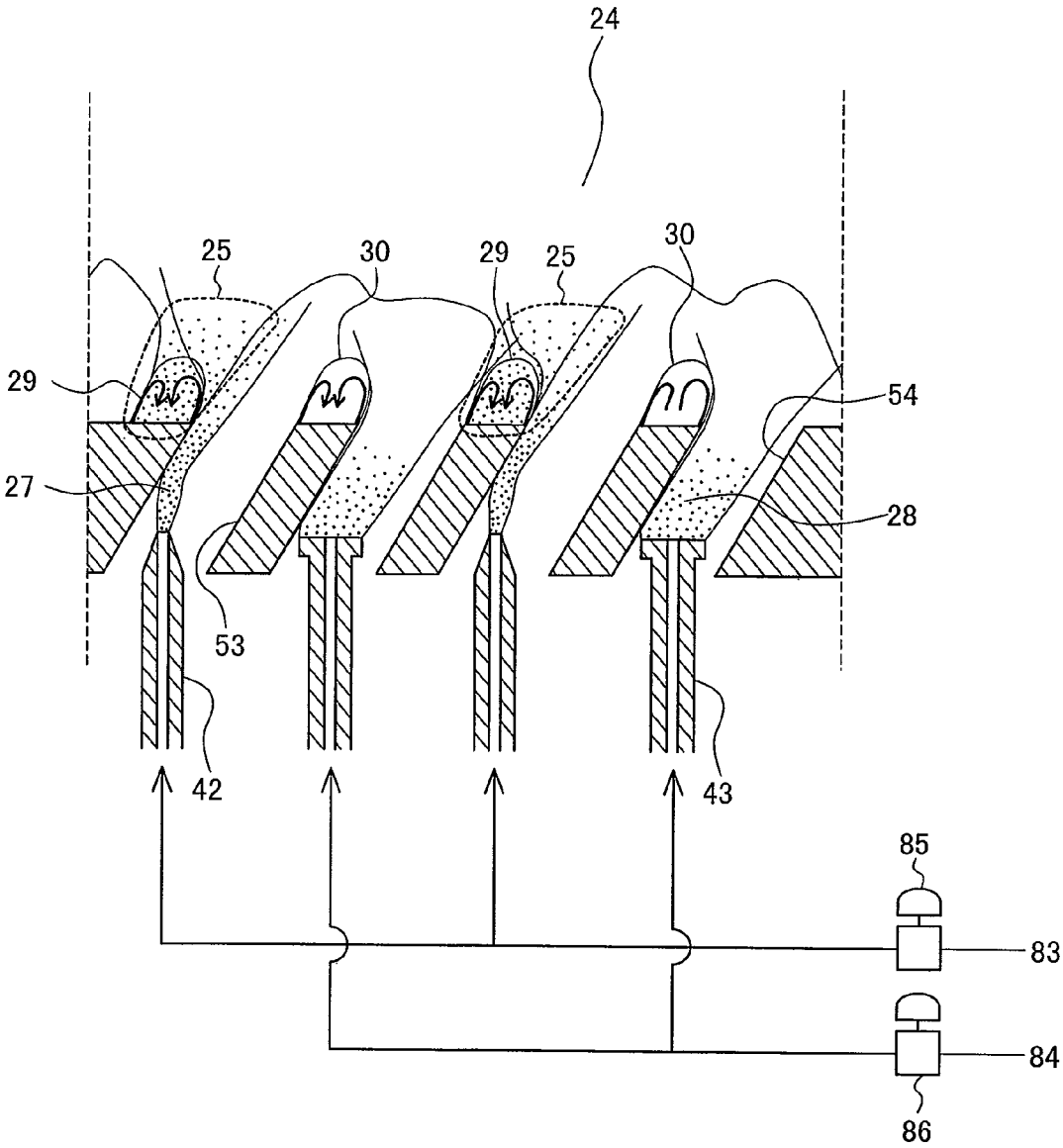
FIG. 23 is a side cross-sectional view showing a fuel nozzle and an air hole, and positional relationships therebetween according to an eighth embodiment of the present invention.

In comparison with the first embodiment of the present invention, the arrangement according to an eighth embodiment of the present invention includes two different systems for supplying fuel to the fuel nozzles inside the central broken line, each being independently controlled. Referring to FIG. 23, fuel is supplied from a fuel supply system 83 to a fuel nozzle 42 constituting the first fuel nozzle group, and fuel is supplied from a fuel supply system 84 to a fuel nozzle 43 constituting the second fuel nozzle group. The fuel supply system 83 and the fuel supply system 84 include flow control valves 85, 86, respectively, allowing independent control of the fuel flow rate.

The arrangement according to the eighth embodiment of the present invention allows the flame base 25 of an optimum combustion amount to be formed at all times under widely ranging operating conditions from starting to a rated load condition. The flame base 25 under the rated load condition provides the minimum essential combustion amount, so that the amount of NOx emissions produced from the flame base 25 can be minimized.

The combustion amount of the flame base 25 is, on the other hand, increased to maintain the flame 24 under conditions of a light gas turbine power generation load and a low fuel air ratio of the entire combustor. To achieve that purpose, the amount of fuel jetted from the first fuel nozzle group relative to air in the air hole is made greater than the amount of fuel jetted from the second fuel nozzle group. This operation helps widen the operating load range of the gas turbine. Under the condition of light power generation load for the gas turbine, the amount of NOx emissions can be kept to a low level thanks to the low fuel air ratio of the entire flame.

Ninth Embodiment

Figure 24:
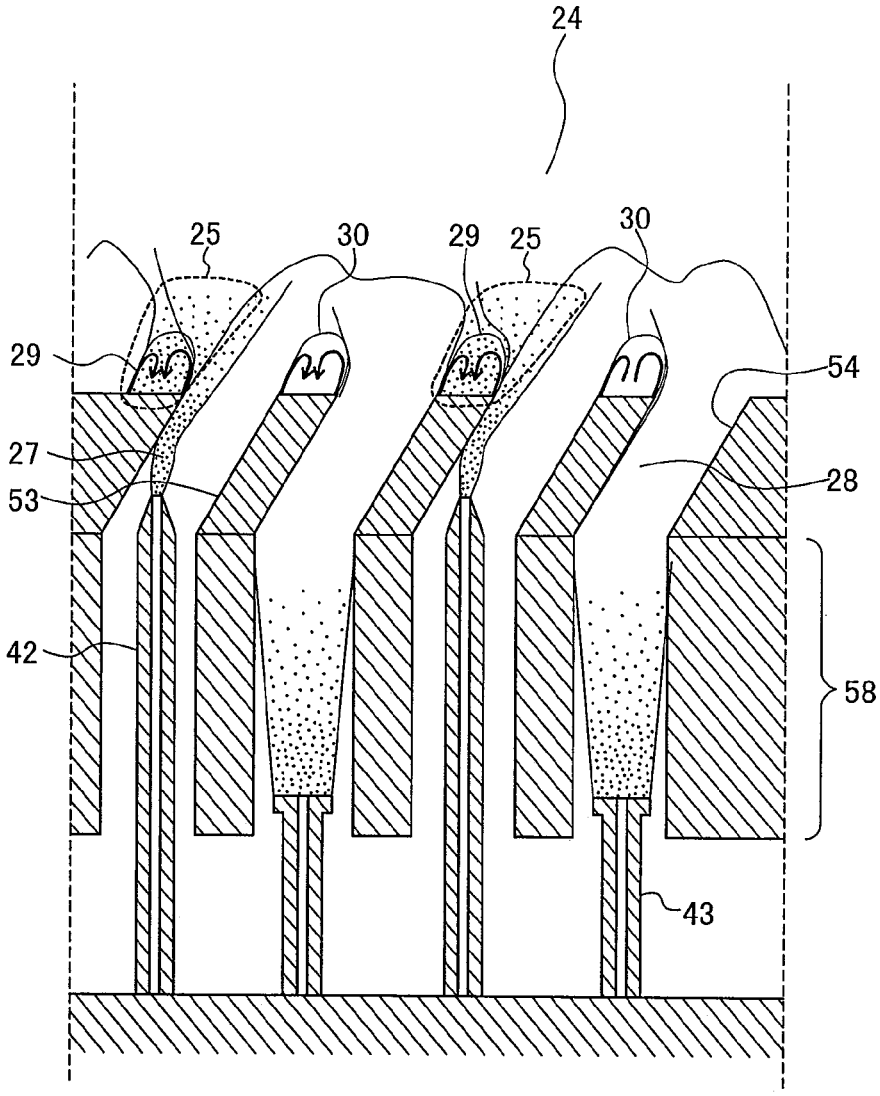
FIG. 24 is a side cross-sectional view showing a fuel nozzle and an air hole, positional relationships therebetween, and a fuel system according to an ninth embodiment of the present invention.

FIG. 24 is an enlarged view showing fuel nozzles and air holes according to a ninth embodiment of the present invention. In comparison with the first embodiment of the present invention, the arrangement according to the ninth embodiment of the present invention is characterized in that the air hole includes a straight section 58 for a longer premix distance for mixing fuel with air. In addition, a fuel nozzle 42 having a tapered leading end is elongated so that the leading end reaches into an inclined section of an air hole 53. A ribbed fuel nozzle 43, on the other hand, has a fuel hole disposed at an inlet of the straight section 58 of the air hole. In FIG. 24, the first fuel nozzle group corresponds to the fuel nozzle 42, while the second fuel nozzle group corresponds to the fuel nozzle 43. In the foregoing arrangement, fuel not mixed with air is jetted from the air hole outlet for the first fuel nozzle group. As a result, there is left a local region having a high fuel concentration.

With the second fuel nozzle group, on the other hand, the premix distance, over which fuel jetted from the fuel nozzle 43 is mixed with air, is longer than that in the first fuel nozzle group. Accordingly, the second fuel nozzle group has high fuel dispersion performance at the outlet cross section of the air hole. As a result, even further reduction in the amount of NOx emissions can be achieved, while maintaining good flame stability of the flame 24.

What is claimed is:

1. A combustor comprising:

a chamber mixing and burning fuel and air;

an air hole plate disposed on a wall surface of the chamber, the air hole plate including a plurality of rows, disposed concentrically, each of a plurality of air holes jetting coaxial jets of fuel and air into the chamber; and a first fuel nozzle and a second fuel nozzle, each disposed near an air hole and jetting fuel into an air hole in an air hole row on an inner peripheral side of the air hole plate, the first fuel nozzle being structured to suppress turbulence of a surrounding air flow and the second fuel nozzle being structured to promote turbulence of a surrounding air flow, wherein, in at least one of first and second air hole rows on the inner peripheral side of the air hole plate, the first fuel nozzles and the second fuel nozzles are disposed one of irregularly and regularly in a circumferential direction of the air hole plate.

2. The combustor according to claim 1, wherein an air hole to which the first fuel nozzle supplies fuel has a diameter smaller than a diameter of an air hole to which the second fuel nozzle supplies fuel.

3. The combustor according to claim 1, wherein at least the second fuel nozzle has a leading end thereof inserted in the air hole.

4. The combustor according to claim 1, wherein the first fuel nozzle has a taper at a leading end thereof and the second fuel nozzle has a rib at a leading end thereof.

5. The combustor according to claim 1, wherein a leading end of the second fuel nozzle is extended outwardly.

6. The combustor according to claim 1, wherein the air hole plate includes an inner region with each air hole having an inclined angle relative to the air hole plate and an outer region with each air hole perpendicularly to the air hole plate.

7. The combustor according to claim 6, wherein the first fuel nozzles disposed on the inner region are disposed at intervals of each of one and two second fuel nozzles.

8. The combustor according to claim 6, wherein an air hole disposed on the outer region has a center axis offset from a center axis of the fuel nozzle supplying the air hole with fuel.

9. The combustor according to claim 1, wherein dispersion performance of the first fuel nozzle group and the second fuel nozzle group is adjusted by varying a leading end shape of the fuel nozzles.

* * * * *